US009014587B2

(12) United States Patent
Sato

(10) Patent No.: US 9,014,587 B2
(45) Date of Patent: Apr. 21, 2015

(54) IMAGE FORMING APPARATUS CAPABLE OF CHANGING ROTATION SPEED OF FIXING MEMBER

(71) Applicant: Oki Data Corporation, Tokyo (JP)

(72) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 4 days.

(21) Appl. No.: 13/864,231

(22) Filed: Apr. 16, 2013

(65) Prior Publication Data

US 2013/0272732 A1 Oct. 17, 2013

(30) Foreign Application Priority Data

Apr. 17, 2012 (JP) ..... 2012-093727
Apr. 5, 2013 (JP) ..... 2013-079993

(51) Int. Cl.
*G03G 15/20* (2006.01)

(52) U.S. Cl.
CPC ..... *G03G 15/2039* (2013.01); *G03G 15/2046* (2013.01)

(58) Field of Classification Search
USPC ..... 399/67–70; 219/216
See application file for complete search history.

(56) References Cited

U.S. PATENT DOCUMENTS

2003/0081962 A1* 5/2003 Murata ..... 399/69
2009/0252518 A1* 10/2009 Eun et al. ..... 399/68
2010/0104307 A1* 4/2010 Shinyama ..... 399/68
2011/0150518 A1* 6/2011 Hase et al. ..... 399/70

FOREIGN PATENT DOCUMENTS

JP 10-104990 4/1998
JP 2000200016 A * 7/2000
JP 2007033618 A * 2/2007
JP 2007304167 A * 11/2007
JP 2009301028 A * 12/2009

* cited by examiner

*Primary Examiner* — Walter L Lindsay, Jr.
*Assistant Examiner* — Milton Gonzalez
(74) *Attorney, Agent, or Firm* — Rabin & Berdo, P.C.

(57) ABSTRACT

An image forming apparatus includes a fixing member configured to fix an image to a medium by heating the medium, a heating member configured to heat the fixing member, a pressure member pressed against the fixing member so as to presses the medium against the fixing member, a first temperature detection unit for detecting a temperature of the fixing member, a second temperature detection unit for detecting a temperature of the pressure member, and a control unit that controls a rotation speed of the fixing member. The control unit controls the rotation speed of the fixing member based on a temperature difference between the temperature detected by the first temperature detection unit and the temperature detected by the second temperature detection unit.

21 Claims, 16 Drawing Sheets

IMAGE FORMING APPARATUS CAPABLE OF CHANGING ROTATION SPEED OF FIXING MEMBER

BACKGROUND OF THE INVENTION

The present invention relates to an image forming apparatus using electrophotography such as a facsimile, a printer, a copier and the like.

A general image forming apparatus using electrophotography includes a fixing unit that fixes a toner image to a sheet by application of heat and pressure. The fixing unit includes a fixing roller having an internal heat source and a pressure roller pressed against the fixing roller. The sheet to which a toner image is transferred is fed through a nip portion between the fixing roller and the pressure roller. When a print command is received, the image forming apparatus starts rotating the fixing roller at the same speed as a printing speed, controls a temperature of the fixing unit, and feeds the sheet through the fixing unit so as to fix the toner image to the sheet.

The fixing unit generally includes temperature sensors for detecting temperatures of the fixing roller and the pressure roller. When the sheet starts to be fed toward the fixing unit, the heat source starts heating the fixing roller. As the fixing roller is heated, a heat storage amount gradually increases. Generally, the heat storage amount reaches a sufficient amount for fixing the toner image when the sheet reaches the fixing roller.

In this regard, when the thickness of the sheet is thin, the temperature of the fixing roller overshoots and finally reaches the target temperature. Therefore, it is necessary to provide a waiting time before starting the feeding of the sheet. In this regard, Japanese Laid-Open Patent Publication No. H10-104990 discloses a configuration capable of reducing the waiting time.

However, in the general image forming apparatus, it is difficult to obtain excellent fixing property.

SUMMARY OF THE INVENTION

An aspect of the present invention is intended to provide an image forming apparatus capable of enhancing fixing property.

According to an aspect of the present invention, there is provided an image forming apparatus including a fixing member configured to fix an image to a medium by heating the medium, a heating member configured to heat the fixing member, a pressure member pressed against the fixing member so as to presses the medium against the fixing member, a first temperature detection unit for detecting a temperature of the fixing member, a second temperature detection unit for detecting a temperature of the pressure member, and a control unit that controls a rotation speed of the fixing member. The control unit controls the rotation speed of the fixing member based on a temperature difference between the temperature detected by the first temperature detection unit and the temperature detected by the second temperature detection unit.

With such a configuration, excellent fixing property can be obtained.

According to another aspect of the present invention, there is provided an image forming apparatus including a fixing member heated by a heating member, the fixing member being configured to fix an image to a medium by heating the medium, a pressure member pressed against the fixing member so as to presses the medium against the fixing member, and a control unit that controls a rotation speed of the fixing member. The control unit causes the fixing member to rotate at a higher speed, as a heat storage amount in the fixing member becomes smaller.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings. The drawings are provided for illustrative purpose and are not intended to limit the scope of the present invention.

First Embodiment

Figure 1:
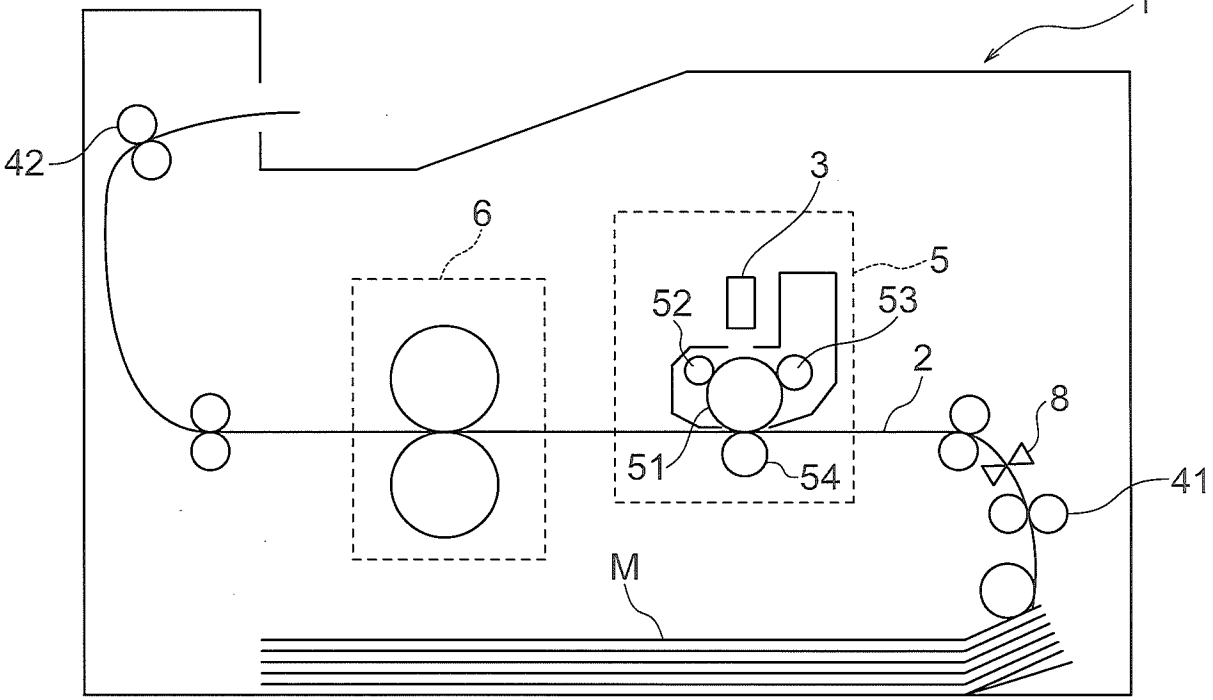
FIG. 1 is a schematic sectional view showing an image forming apparatus according to the first embodiment of the present invention.

FIG. 1 is a schematic sectional view showing an image forming apparatus 1 according to the first embodiment of the present invention. The image forming apparatus 1 includes a medium feeding unit 41, an LED head 3 (i.e., an exposure unit), a toner image forming unit 5 (i.e., a developer image forming unit), a fixing unit 6, and a medium ejection unit 42. The medium feeding unit 41, the writing sensor 8, the toner image forming unit 5, the fixing unit 6, and the medium ejection unit 42 are arranged in this order along a medium feeding path 2.

The medium feeding unit 41 is configured to feed a medium M such as a paper to a medium feeding path 2. The LED head 3 is provided adjacent to the toner image forming unit 5, and configured to emit light so as to expose a surface of a photosensitive drum 51 (described later) of the toner image forming unit 5 to form a latent image.

The toner image forming unit 5 includes the photosensitive drum 51 (i.e., a image bearing body) that rotates in a predetermined direction (clockwise in FIG. 1), a charging member 52 that uniformly charges the surface of the photosensitive drum 51, and a developing unit 53 that develops the latent image (formed by the LED head 3) on the surface of the photosensitive drum 51 using a toner as a developer. A transfer member 54 is provided so as to face the photosensitive drum 51 via the medium feeding path 2 for transferring a toner image from the photosensitive drum 51 to the medium M. A writing sensor 8 is provided upstream of the toner image forming unit 5 along the medium feeding path 2 for detecting a position of the medium M.

The fixing unit 6 is configured to fix the toner image (having been transferred to the medium M) to the medium M. The medium ejection unit 42 is configured to eject the medium M (to which the toner image is fixed) outside the image forming apparatus 1.

When a printing control unit 100 (FIG. 2) of the image forming unit 1 receives a print command, the medium feeding unit 41 feeds the medium M along the medium feeding path 2 toward the toner image forming unit 5 at a timing in synchronization with image formation by the toner image forming unit 5. In the toner image forming unit 5, the surface of the photosensitive drum 51 is uniformly charged by the charging member 52. The LED head 3 emits light according to image data, and a latent image is formed on the surface of the photosensitive drum 51. The latent image is developed by the developing unit 53, so that a toner image (i.e., a developer image) is formed on the photosensitive drum 51. The toner image is transferred from the photosensitive drum 51 to the medium M when the medium M passes a nip portion between the photosensitive drum 51 and the transfer member 54. The medium M to which the toner image is transferred is fed to the fixing unit 6. The fixing unit 6 fixes the toner image to the medium M by application of heat and pressure (i.e., a fixing process). The medium ejection unit 42 ejects the medium M (to which the toner image is fixed) outside the image forming apparatus 1.

Figure 2:
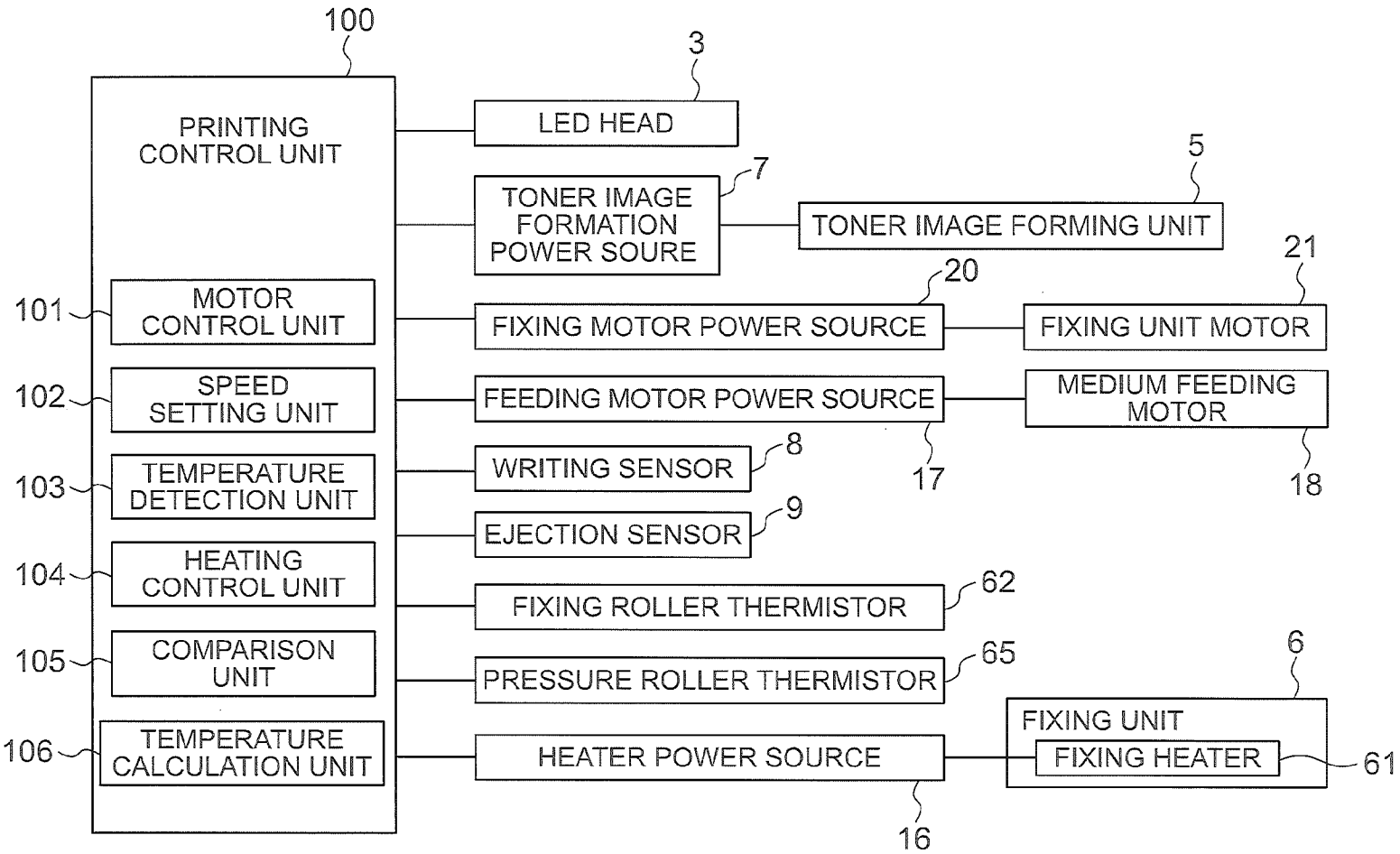
FIG. 2 is a block diagram showing a control system of the image forming apparatus according to the first embodiment.

FIG. 2 is a block diagram showing a control system of the image forming apparatus 1 according to the first embodiment. The printing control unit 100 (i.e., a controller) is connected to the LED head 3, a toner image formation power source 7, a feeding motor power source 17, a fixing motor power source 20, the writing sensor 8, an ejection sensor 9, a fixing roller thermistor 62 (i.e., a first temperature detection unit), a pressure roller thermistor 65 (i.e., a second temperature detection unit), and a heater power source 16.

The toner image formation power source 7 is connected to the toner image forming unit 5 to supply electric power to the toner image forming unit 5. The feeding motor power source 17 is connected to a medium feeding motor 18 to supply electric power to the medium feeding motor 18. The fixing motor power source 20 is connected to a fixing unit motor 21 to supply electric power to the fixing unit motor 21. The heater power source 16 is connected to a fixing heater 61 of the fixing unit 6.

The printing control unit 100 controls respective components of the image forming apparatus 1 so as to perform an image forming operation. The LED head 3 emits light according to image data to expose the surface of the photosensitive drum 51 of the toner image forming unit 5. The toner image formation power source 7 applies voltages to the toner image forming unit 5. For example, the toner image formation power source 7 includes a charging power source that applies a charging voltage to the charging roller 52, a developing power source that applies a developing voltage to the developing unit 53, and a transfer power source that applies a transfer voltage to the transfer member 54. The fixing unit motor 21 is driven by the electric power supplied by fixing motor power source 20, and causes a fixing roller 64 (described later) of the fixing unit 6 to rotate.

The writing sensor 8 is configured to detect a position of the medium M along the medium feeding path 2. The fixing unit 6 includes a fixing roller 64 (i.e., a fixing member), a pressure roller 63 (i.e., a pressure member) pressed against the fixing roller 64 to form a nip portion, and a fixing heater 61 (i.e., a heating member) for heating the fixing roller 64. The heater power source 16 supplies electric power to the fixing heater 61. The fixing roller thermistor 62 (i.e., a first temperature detection unit) detects a temperature of the fixing roller 64 of the fixing unit 6. The pressure roller thermistor 65 (i.e., a second temperature detection unit) detects a temperature of the pressure roller 63 of the fixing unit 6.

The printing control unit 100 includes a motor control unit 101, a speed setting unit 102, a temperature detection unit 103, a temperature difference calculation unit 106, a heating control unit 104 and a comparison unit 105. The motor control unit 101 controls electric power supply to the feeding motor power source 17 and the fixing motor power source 20 so as to control operations of the medium feeding motor 18 and the fixing unit motor 21. The motor control unit 101 controls electric power supply to the feeding motor power source 17 and the fixing motor power source 20 based on a rotation speed V which is set by the speed setting unit 102.

The speed setting unit 102 (i.e., a rotation speed control unit) controls the rotation speed V of the fixing unit motor 21 according to operating conditions of the image forming apparatus 1. To be more specific, the speed setting unit 102 sets the rotation speed V of the fixing unit motor 21 before the medium M starts passing through the fixing unit 6 to a rotation speed Vprn based on a temperature difference ΔT0 between temperatures of the fixing roller 64 and the pressure roller 63 (steps S104 and S111 in FIG. 5). Further, the speed setting unit 102 calculates an optimum pre-arrival rotation speed $V_A$ (step S107 in FIG. 5). The speed setting unit 102 sets the rotation speed V of the fixing unit motor 21 to the calculated optimum pre-arrival rotation speed $V_A$ (step S109 in FIG. 5).

The temperature detection unit 103 detects surface temperatures of the fixing roller 64 (i.e., an upper roller) and the pressure roller 63 (i.e., a lower roller) using the fixing roller thermistor 62 and the pressure roller thermistor 65. The temperature difference calculating unit 106 calculates the temperature difference ΔT0 between surface temperatures of the fixing roller 64 and the pressure roller 63. The heating control unit 104 controls the heater power source 16 so as to keep a temperature of the fixing unit 6 within a fixing-enabling temperature range (i.e., a printing-enabling temperature range). To be more specific, the heating control unit 104 determines whether the temperature detected by the fixing roller thermistor 62 is within the predetermined fixing-enabling temperature range. Based on a determination result, the heating control unit 104 increases the temperature of the fixing roller 64 by supplying electric power to the fixing heater 61 from the heater power source 16, or decreases the temperature of the fixing roller 64 to decrease by stopping supplying of the electric power to the fixing heater 61 from the heater power source 16. The comparison unit 105 compares information (for examples, the temperatures of the fixing roller 64 and the pressure roller 63) according to instruction from the printing control unit 100.

Figure 3:
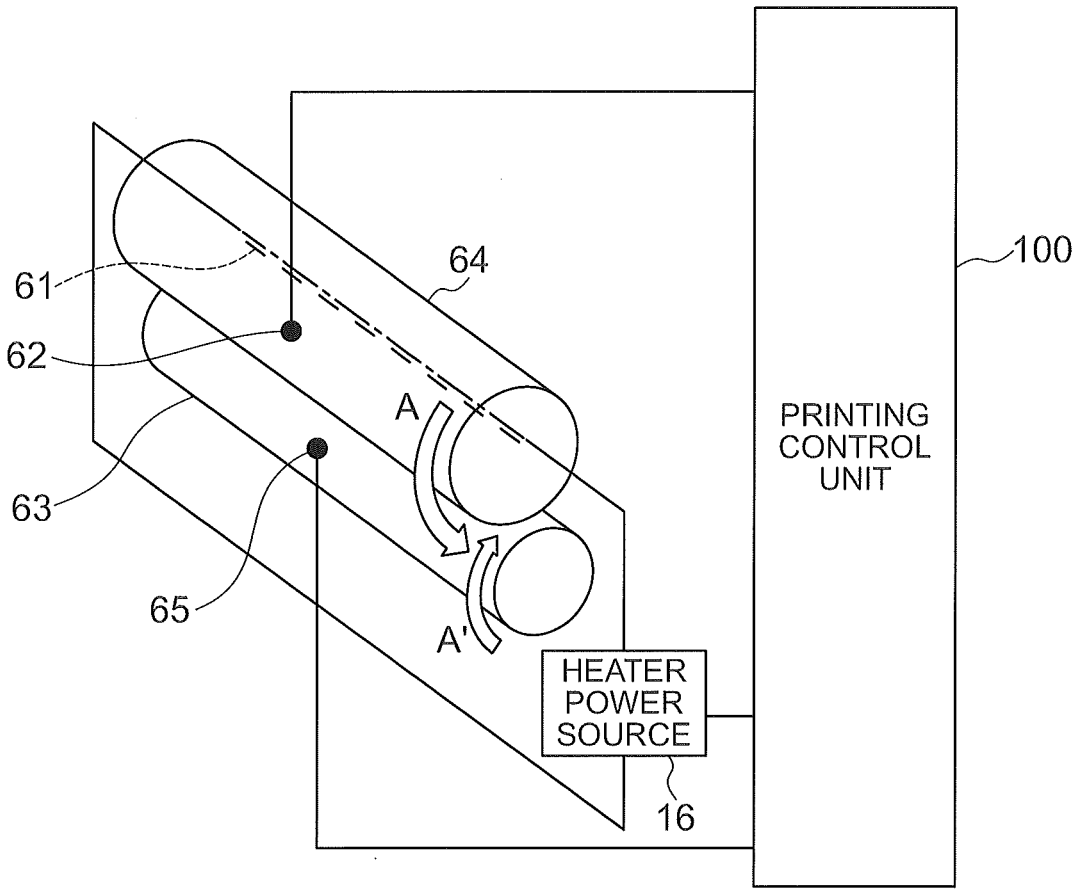
FIG. 3 is a schematic view showing a fixing unit according to the first embodiment.

FIG. 3 is a perspective view showing a configuration of the fixing unit 6 according to the first embodiment. The fixing unit 6 includes the fixing roller 64 as a fixing member, the fixing heater 61 as a heating unit, the pressure member 63 as a pressure member, the fixing roller thermistor 62 as a first temperature detection unit, and the pressure roller thermistor 65 as a second temperature detection unit. In an example shown in FIG. 3, the fixing roller 64 is disposed above the pressure roller 63. The fixing roller 64 is configured to supply heat to the medium M and convey the medium M. The fixing heater 61 is configured to heat the fixing roller 64. The fixing roller thermistor 62 is configured to detect the surface temperature of the fixing roller 64. The pressure roller thermistor 65 is configured to detect the surface temperature of the pressure roller 63.

The fixing roller 64 has a cylindrical shape, and includes a hollow cylindrical metal core in which the fixing heater 61 is provided. The pressure roller 63 (for applying pressure to the medium M) is pressed against the fixing roller 64 to form a nip portion between the fixing roller 64 and the pressure roller 63. The fixing roller 64 and the pressure roller 63 rotate as shown by arrows A and A' so that the medium M passes through the nip portion. The fixing heater 61 is connected to the heater power source 16. The heater power source 16 is connected to the printing control unit 100 as described above. The temperature calculating unit 106 of the printing control unit 100 calculates the temperature difference ΔT0 (i.e., an upper/lower temperature difference ΔT0) between the fixing roller 64 and the pressure roller 63 based on the temperatures detected by the fixing roller thermistor 62 and the pressure roller thermistor 65.

Figure 4C:
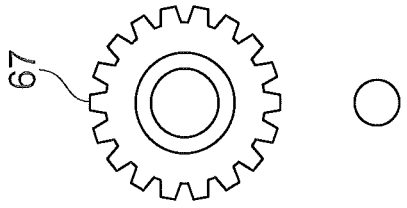
FIGS. 4B and 4C are cross sectional views respectively taken along a line 4B-4B and a line 4C-4C in FIG. 4A.
Figure 4B:
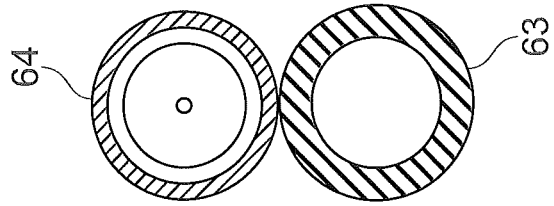
Figure 4A:
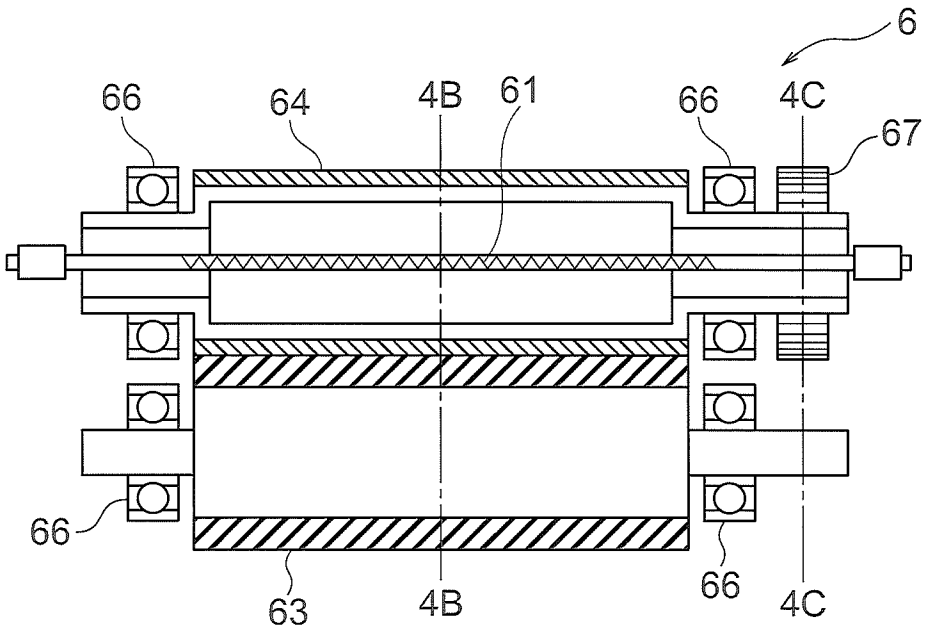
FIG. 4A is a longitudinal sectional view showing the fixing unit according to the first embodiment.

FIG. 4A is a longitudinal sectional view showing the fixing unit 6 according to the first embodiment. FIG. 4B is a cross sectional view taken along a line 4B-4B in FIG. 4A at a center of the fixing unit 6 in a longitudinal direction. FIG. 4C is a cross sectional view taken along a line 4C-4C in FIG. 4A at an end portion of the fixing unit 6 in the longitudinal direction. The fixing unit 6 includes the fixing roller 64, the pressure roller 63, ball bearings 66 (i.e., rotation supporting members) and a gear 67 (i.e., a driving force transmission unit). The ball bearings 66 rotatably support the fixing roller 64 and the pressure roller 63. The gear 67 is provided for transmitting a driving force from the fixing unit motor 21 to the fixing roller 64.

The fixing roller 64 contacts the pressure roller 63 to form the nip portion therebetween. The fixing heater 61 is mounted inside the fixing roller 64 in a non-contact manner. The fixing roller thermistor 62 is provided so as to contact the surface of the fixing roller 64. The pressure roller thermistor 65 is provided so as to contact the surface of the pressure roller 63. In this regard, it is also possible to provide the fixing heater 61 so as to contact the fixing roller 64. Further, it is also possible to provide the fixing roller thermistor 62 so as not to contact the surface of the fixing roller 64. It is also possible to provide the pressure roller thermistor 65 so as not to contact the surface of the pressure roller 63.

The ball bearings 66 are provided on both ends of the fixing roller 64 and both ends of the pressure roller 63. The gear 67 is provided on an end of the fixing roller 64. For example, the fixing roller 64 includes a metal core (i.e., a base body) having a diameter of 30 mm formed of an iron tube, and an elastic layer having a thickness of 1 mm formed of silicone rubber. The metal core of the fixing roller 64 is rotatably supported by the ball bearings 66 at both ends. The gear 67 as the driving force transmission unit is fixed to one end of the metal core of the fixing roller 64.

The fixing unit motor 21 is constituted by, for example, a pulse motor. The fixing unit motor 21 of this embodiment has a control-pulse generator. When the printing control unit 100 provides the fixing unit motor 21 with electric power and clock signal having a frequency (i.e., a clock frequency), the fixing unit motor 21 rotates at the rotation speed V corresponding to the clock frequency. The printing control unit 100 controls the rotation speed V of the fixing unit motor 21 by controlling the clock frequency. The pressure roller 63 is pressed against the fixing roller 64 by a resilient member such as a spring or the like. The nip portion is formed between the pressure roller 63 and the fixing roller 64. Therefore, when the fixing roller 64 rotates, the pressure roller 63 also rotates following the rotation of the fixing roller 64.

Each of the fixing roller thermistor 62 and the pressure roller thermistor 65 is formed of an element whose resistance varies depending on a temperature. The temperature detection unit 103 of the printing control unit 100 obtains the temperatures detected by the fixing roller thermistor 62 and the pressure roller thermistor 65 based on the resistances of the fixing roller thermistor 62 and the pressure roller thermistor 65. The fixing roller thermistor 62 contacts the surface of the fixing roller 64, and the pressure roller thermistor 65 contacts the surface of the pressure roller 63. The temperature detection unit 103 detects the temperatures of the fixing roller 64 and the pressure roller 63 by detecting outputs the thermistors 62 and 65. In this embodiment, each of the fixing roller thermistor 62 and the pressure roller thermistor 65 is formed of an element whose resistance decreases as a temperature increases.

The fixing heater 61 is a heating element that generates heat when supplied with electric power from a utility power source or the like. For example, the fixing heater 61 is formed of a halogen heater. A voltage applied to the fixing heater 61 is, for example, 100 V. An output of the fixing heater 61 is, for example, 800 W. A component of the fixing roller 64 has a relatively large heat capacity. It takes time for heat to be transferred from an inner surface to an outer surface of the fixing roller 64. Therefore, there is a delay after the fixing heater 61 starts generating heat (i.e., after the fixing heater 61 starts heating the metal core of the fixing roller 64) and before the surface temperature of the fixing roller 64 starts increasing.

Figure 5:
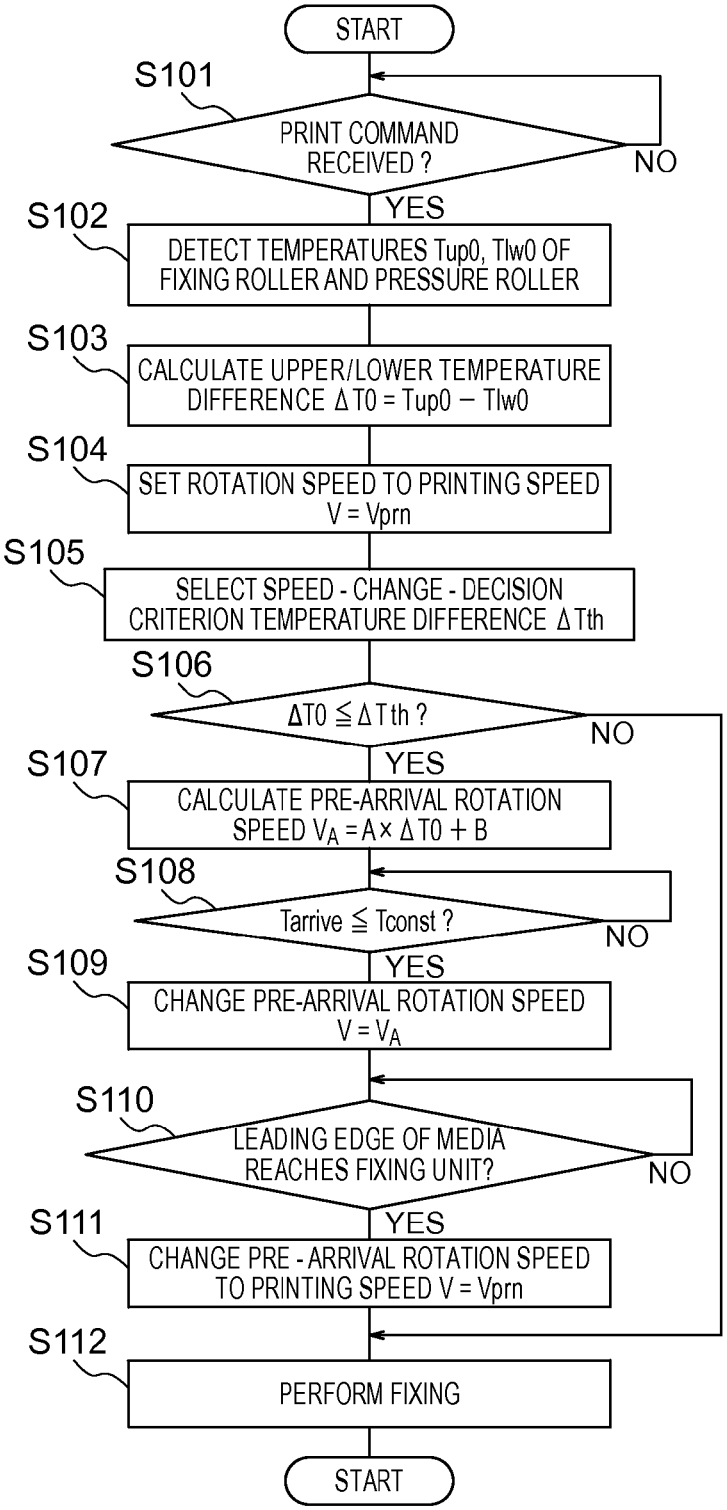
FIG. 5 is a flowchart showing an operation for controlling a rotation speed of a fixing unit motor according to the first embodiment.

An operation of the fixing unit 6 according to the first embodiment will be described with reference to FIGS. 2 and 5. When the printing control unit 100 receives no print command (i.e., when the image forming apparatus 1 is in a standby state), the heating control unit 104 of the printing control unit 100 keeps the fixing unit 6 at a temperature (for example, 195° C.) at which fixing can be well performed so that image formation can be started as soon as receiving print command. In this state, the fixing roller 64 does not rotate.

When the printing control unit 100 receives the print command, the printing control unit 100 decides whether the temperature of the fixing roller 64 is in a fixing-enabling temperature range (described later). When the printing control unit 100 decides that the temperature of the fixing roller 64 is not within the fixing-enabling temperature range, the printing control unit 100 does not start feeding the medium M until the temperature of the fixing roller 64 reaches the fixing-enabling temperature range. When the printing control unit 100 decides that the temperature of the fixing roller 64 is within the fixing-enabling temperature range, the printing control unit 100 causes the medium feeding unit 4 to start feeding the medium M by supplying electric power to the medium feeding motor 18 from the feeding motor power source 17 in synchronization with image formation. Therefore, the medium M is fed along the medium feeding path 2 toward the toner image forming unit 5.

The printing control unit 100 causes the LED head 3 to emit light according to image data to expose the surface of the photosensitive drum 51, and a latent image is formed on the surface of the photosensitive drum 51. The latent image is developed by the developing unit 53, and a toner image is formed on the surface of the photosensitive drum 51. The toner image is transferred from the photosensitive drum 51 to the medium M by the transfer member 54. The medium M is then fed to the fixing unit 6, and the toner image is fixed to the medium M by application of heat and pressure. Thereafter, the medium M is ejected outside the image forming apparatus 1.

A temperature control of the fixing unit 6 by the heat controlling unit 104 will be herein described. The heating control unit 104 decides whether the temperature detected by the fixing roller thermistor 62 is in the fixing-enabling temperature range (i.e., the printing-enabling temperature range). When the printing control unit 100 decides that the temperature of the fixing unit 6 is in the fixing-enabling temperature range, the motor control unit 101 of the printing control unit 100 supplies electric power to the feeding motor power source 17 to thereby drive the medium feeding motor 18. That is, the medium feeding unit 41 starts feeding the medium M.

The "fixing-enabling temperature range" is a temperature range in which a toner image can be fixed to the medium M. The fixing-enabling temperature range has a lower limit temperature T1 and an upper limit temperature T2. Further, a setting temperature Tprn is defined between the lower limit temperature T1 and the upper limit temperature T2. The lower limit temperature T1 is, for example, 175° C. The upper limit temperature T2 is, for example, 205° C. The setting temperature Tprn is, for example, 190° C. When the temperature of the fixing roller 64 (detected by the fixing roller thermistor 62) is higher than the setting temperature Tprn, the heating control unit 104 stops supplying electric power to the fixing heater 61 from the heater power source 16 so that the temperature of the fixing roller 64 decreases. In other words, the heating control unit 104 performs a cool-down operation. When the temperature of the fixing roller 64 (detected by the fixing roller thermistor 62) is lower than the setting temperature Tprn, the heating control unit 104 supplies electric power to the fixing heater 61 from the heater power source 16 so that the temperature of the fixing roller 64 increases. In other words, the heating control unit 104 performs a warm-up operation. That is, the heating control unit 104 keeps the temperature of the fixing roller 64 in the fixing-enabling temperature range. Therefore, suitable amount of heat is applied to the medium M, and fixing failure is prevented.

A method of controlling the rotation speed V of the fixing unit motor 21 according to the first embodiment will be described. FIG. 5 is a flowchart showing an operation for controlling the rotation speed of the fixing unit motor 21 according to the first embodiment.

First, the printing control unit 100 decides whether the printing control unit 100 receives print command from a host device such as a computer (S101). If the printing control unit 100 receives print command (YES in step S101), the printing control unit 100 proceeds to step S102.

In step S102, the temperature detection unit 103 of the printing control unit 100 detects the temperatures of the fixing roller 64 and the pressure roller 63. The detected temperature of the fixing roller 64 is referred to as a temperature Tup0. The detected temperature of the pressure roller 63 is referred to as a temperature Tlw0.

If the temperature Tup0 is within the fixing-enabling temperature range, the printing control unit 100 proceeds to step S103. If the temperature Tup0 is out of the fixing-enabling temperature range, the printing control unit 100 waits until the temperature of the fixing roller 64 reaches the fixing-enabling temperature range.

Then, in step S103, the temperature difference calculating unit 106 of the printing control unit 100 calculates the temperature difference ΔT0 between current temperatures of the fixing roller 64 and the pressure roller 63 based on the temperatures Tup0 and Tlw0 detected by the temperature detection unit 103 using the following equation:

$$\Delta T0 = Tup0 - Tlw0$$

Next, in step S104, the printing control unit 100 extracts a requested printing speed from the print command sent from the host device. The requested printing speed is referred to as a printing speed Vprn. The speed setting unit 102 of the printing control unit 100 sets the rotation speed V of the fixing unit motor 21 to the printing speed Vprn.

Then, in step S105, the printing control unit 100 selects a speed-change-decision criterion temperature difference ΔTth for deciding whether or not to change the rotation speed V of the fixing unit motor 21.

The "speed-change-decision criterion temperature difference ΔTth" is a temperature difference between the fixing roller 64 and the pressure roller 63 based on which decision on whether or not to change the rotation speed V of the fixing unit motor 21 is performed. The speed-change-decision criterion temperature difference ΔTth is set according to the printing speed. For example, when the printing speed Vprn is 200 mm/s, the speed-change-decision criterion temperature difference ΔTth is 50° C. When the printing speed Vprn is 125 mm/s, the speed-change-decision criterion temperature difference ΔTth is 100° C. When the printing speed Vprn is 50 mm/s, the speed-change-decision criterion temperature difference ΔTth is 150° C.

A method of determining the speed-change-decision criterion temperature difference ΔTth will be described with reference to FIGS. 6 and 7.

Figure 6:
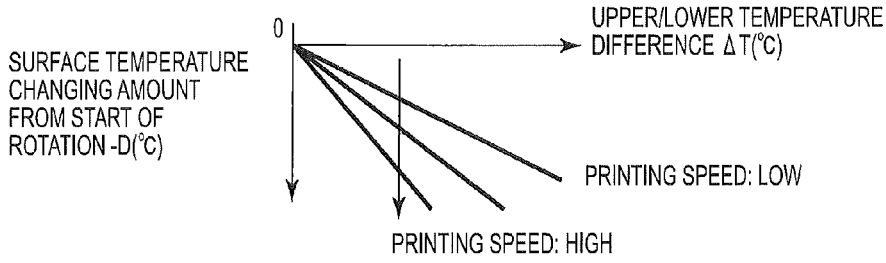
FIG. 6 is a schematic view for illustrating a relationship between an upper/lower temperature difference ΔT0 and a surface temperature changing amount D from start of rotation according to the first embodiment.

FIG. 6 is a schematic view for illustrating a relationship between the upper/lower temperature difference ΔT0 and a surface temperature changing amount D from start of rotation of the fixing roller 64 according to the first embodiment. The "upper/lower temperature difference ΔT0" is a difference between the detected temperatures of the fixing roller 64 and the pressure roller 63. The "surface temperature changing amount D from start of rotation" is a changing amount in the surface temperature of the fixing roller 64 during a predetermined time period after the fixing roller 64 starts rotation from the standby state. FIG. 6 shows the relationship between the upper/lower temperature difference ΔT0 and the surface temperature changing amount D from the start of rotation of the fixing roller 64 for difference printing speeds.

When the upper/lower temperature difference ΔT0 is large, the temperature difference between the fixing roller 64 and the pressure roller 63 is large. For example, the temperature of the fixing roller 64 is 195° C., the temperature of the pressure roller 63 is 95° C., and the upper/lower temperature difference ΔT0 is 100° C. When the fixing roller 64 rotates in this state, a large amount of heat is transferred from the fixing roller 64 to the pressure roller 63 per unit time. Therefore, the temperature of the fixing roller 64 decreases by a large amount.

In contrast, when the upper/lower temperature difference ΔT0 is small, the temperature difference between the fixing roller 64 and the pressure roller 63 is small. For example, the temperature of the fixing roller 64 is 195° C., the temperature of the pressure roller 63 is 150° C., and the upper/lower temperature difference ΔT0 is 45° C. Therefore, a small amount of heat is transferred from the fixing roller 64 to the pressure roller 63 per unit time. Thus, the temperature of the fixing roller 64 decreases by a small amount.

Accordingly, the upper/lower temperature difference ΔT0 is proportional to a negative value (−D) of the surface temperature changing amount D from the start of rotation.

Further, when the rotation speed V of the fixing roller 64 changes, the surface temperature changing amount D from the start of rotation of the fixing roller 64 also changes. In other words, when the rotation speed V of the fixing roller 64 becomes high, a frequency with which the fixing roller 64 and the pressure roller 63 contact each other increases. As a result, a larger amount of heat is transferred from the fixing roller 64 to the pressure roller 63. Therefore, for the same upper/lower temperature difference ΔT0, the amount of heat transferred from the fixing roller 64 to the pressure roller 63 (i.e., the amount of heat drawn from the fixing roller 64) per unit time increases as the rotation speed V increases. In other words, the decrease in temperature of the fixing roller 64 becomes large as the rotation speed V increases. In contrast, when the rotation speed V becomes low, the amount of heat transferred from the fixing roller 64 to the pressure roller 63 per unit time becomes small.

Figure 7:
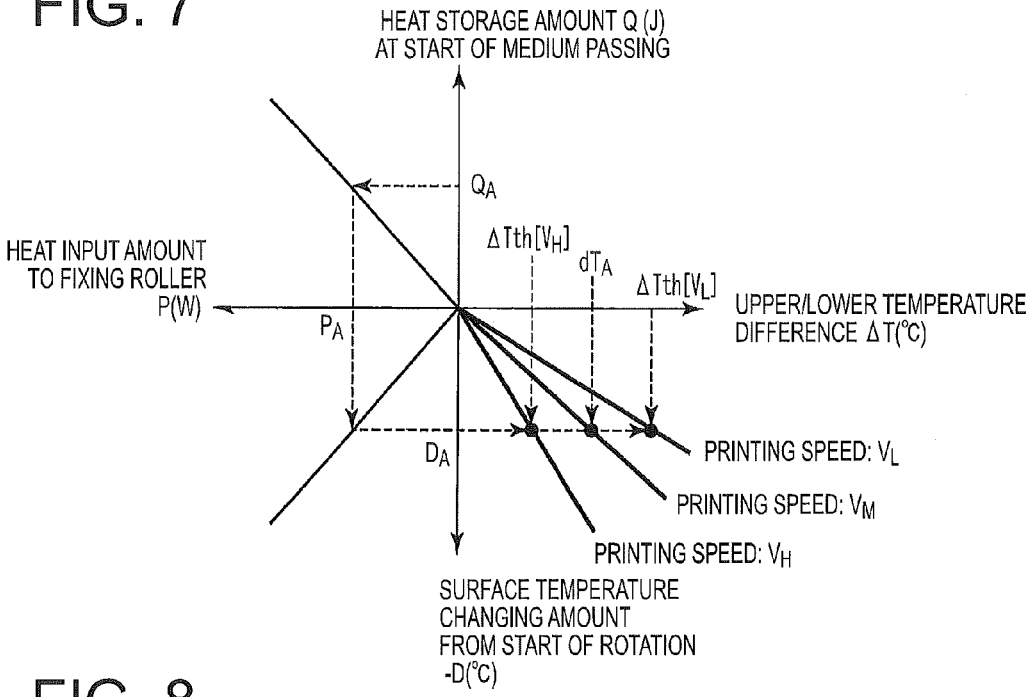
FIG. 7 is a schematic view for illustrating a relationship among the upper/lower temperature difference ΔT0, the surface temperature changing amount D from start of rotation, a heat input amount P, a heat storage amount Q at start of medium passing, and a speed-change-decision criterion temperature difference ΔTth according to the first embodiment.

FIG. 7 is a schematic view for illustrating a relationship among the upper/lower temperature difference ΔT0, the surface temperature changing amount D from the start of rotation, a heat input amount P, a heat storage amount Q at start of medium passing, and the speed-change-decision criterion temperature difference ΔTth according to the first embodiment.

The "heat input amount P (W)" is an amount of heat input into the fixing roller 64 by the heat control unit 104 after the fixing roller 64 starts rotating and before the medium M reaches the fixing unit 6. In other words, the heat input amount P (W) is an amount of heat to increase the temperature of the fixing roller 64 to the temperature at which fixing can be performed. The heat input amount P (W) is determined based on the surface temperature changing amount D from the start of rotation of the fixing roller 64. The "heat storage amount Q (J) at start of medium passing" is an amount of heat having been stored in the fixing roller 64 at a timing when the medium M starts passing through the fixing unit 6. The speed-change-decision criterion temperature difference ΔTth will be described below. It is herein assumed that the printing speed V is low. However, the same can be said of a case where the printing speed V is high.

When the upper/lower temperature difference ΔT0 is large, the surface temperature changing amount D from the start of rotation of the fixing roller 64 becomes large in a negative (minus) direction as was described with respect to FIG. 6. In order to keep the surface temperature of the fixing roller 64 within the fixing-enabling temperature range (i.e., the printing-enabling temperature range), the heating control unit 104 increases the heat input amount P by supplying electric power to the fixing heater 61. Therefore, if the surface temperature changing amount D from the start of rotation of the fixing roller 64 is large, the heating control unit 104 is required to cause the fixing heater 61 to generate more heat. Due to heat capacity and heat resistance of the fixing roller 64, the heat storage amount Q at the start of medium passing (i.e., the amount of heat having been stored in the fixing roller 64 when the medium M starts passing through the fixing unit 6) increases as the heat input amount P increases. The heat input amount P and the heat storage amount Q at the start of medium passing are proportional to each other as shown in FIG. 7.

In contrast, when the upper/lower temperature difference ΔT0 is small, the surface temperature changing amount D from the start of rotation of the fixing roller 64 becomes small as shown in FIG. 6. The heating control unit 104 decreases the heat input amount P, and therefore the heat storage amount Q at the start of medium passing decreases.

As a result, it is understood that the heat storage amount Q at the start of medium passing changes depends on a change in the upper/lower temperature difference ΔT0 when the fixing roller 64 starts rotation. In other words, if the upper/lower temperature difference ΔT0 is large, the heat storage amount Q at the start of medium passing becomes large. If the upper/lower temperature difference ΔT0 is small, the heat storage amount Q at the start of medium passing becomes small.

When the medium M passes through the fixing unit 6, the fixing roller 64 in a high temperature (for example, 180° C.) contacts the medium M in a low temperature (for example, 25° C.). Since the temperature difference between the fixing roller 64 and the medium M is large, a large amount of heat is transferred from the fixing roller 64 to the medium M. In other words, a large amount of heat is drawn from the fixing roller 64, and the surface temperature of the fixing roller 64 is going to largely decrease.

In such a case, if the heat storage amount Q at the start of medium passing is small, heat supplied to the surface of the fixing roller 64 from inside decreases, and therefore the surface temperature of the fixing roller 64 largely decreases. Even if the heating control unit 104 detects a decrease in the surface temperature of the fixing roller 64 and causes the fixing heater 61 to generate more heat, it takes time for the heat (generated by the fixing heater 61) to reach the surface of the fixing roller 64. Therefore, the surface temperature of the fixing roller 64 keeps decreasing until the heat reaches the surface of the fixing roller 64. As a result, the surface temperature of the fixing roller 64 largely decreases.

In contrast, if the heat storage amount Q at the start of medium passing is large, heat is transferred from the fixing roller 64 to the medium M, but heat is also supplied to the surface of the fixing roller 64 from inside. Therefore, decrease in the surface temperature of the fixing roller 64 is relatively small.

If the decrease in the surface temperature of the fixing roller 64 is large, a sufficient amount of heat is not supplied to the medium M, which results in fixing failure. Therefore, in order to prevent fixing failure, the heat storage amount Q at the start of medium passing needs to be large. A heat storage amount Q (at start of medium passing) needed to prevent fixing failure is referred to an optimum heat storage amount $Q_A$. The heat input amount P corresponding to the optimum heat storage amount $Q_A$ is referred to as a heat input amount $P_A$. The surface temperature changing amount D (from the start of rotation) of the fixing roller 64 corresponds to the heat input amount $P_A$ is referred to as a surface temperature changing amount $D_A$ from the start of rotation.

The surface temperature changing amount $D_A$ from the start of rotation changes depending on the rotation speed V (also referred to as a printing speed) of the fixing roller 64 in a printing process as shown in FIG. 7. Herein, description will be made of cases where the rotation speed V is high and the rotation speed V is low.

When the rotation speed V is high in FIG. 7, if the upper/lower temperature difference ΔT0 is larger than the speed-change-decision criterion temperature difference ΔTth, the heat storage amount Q larger than the optimum heat storage amount $Q_A$ can be obtained at the rotation speed V. Therefore, it is not necessary to increase the heat storage amount Q by increasing the rotation speed V.

In contrast, if the upper/lower temperature difference ΔT0 is smaller than the speed-change-decision criterion temperature difference ΔTth in FIG. 7, it is necessary to increase the heat storage amount Q by increasing the rotation speed V. The upper/lower temperature difference ΔT0 based on which whether or not to change the rotation speed V is decided is referred to as the speed-change-decision criterion temperature difference ΔTth. The speed-change-decision criterion temperature difference ΔTth when the rotation speed V is high ($V_H$) is expressed as ΔTth [$V_H$].

Similarly, the speed-change-decision criterion temperature difference ΔTth when the rotation speed V is low ($V_L$) is expressed as ΔTth [$V_L$]. The speed-change-decision criterion temperature difference ΔTth [$V_L$] is larger than the speed-change-decision criterion temperature difference ΔTth [$V_H$]. In other words, the following equation is satisfied: ΔTth [$V_H$] <ΔTth [$V_L$]. The value of the speed-change-decision criterion temperature difference ΔTth changes depending on the rotation speed V.

This indicates that, when the rotation speed V is low, it is necessary to increase the rotation speed V more than when the rotation speed V is high for the same upper/lower temperature difference ΔT0. In other words, when the rotation speed V is low, an amount of heat transferred from the fixing roller 64 to the pressure roller 63 is small, and therefore it is necessary to rotate the fixing roller 64 at a higher speed in order to increase the heat storage amount Q for the same upper/lower temperature difference ΔT0.

As described above, the speed-change-decision criterion temperature difference ΔTth [Vprn] is determined according to the rotation speed of the fixing roller 64 (i.e., the printing speed).

Referring back to FIG. 5, in step S106, the printing control unit 100 instructs the comparison unit 105 to compare the upper/lower temperature difference ΔT0 calculated by the temperature difference calculation unit 106 and the speed-change-decision criterion temperature difference ΔTth selected by the printing control unit 100.

When the comparison unit 105 determines that the upper/lower temperature difference ΔT0 is smaller than or equal to the speed-change-decision criterion temperature difference ΔTth (i.e., ΔT0≤ΔTth), the printing control unit 100 changes the pre-arrival rotation speed V (step S107). The pre-arrival rotation speed V is the rotation speed V of the fixing unit motor 21 before the medium M reaches the fixing unit 6.

When the comparison unit 105 determines that the upper/lower temperature difference ΔT0 is larger than the speed-change-decision criterion temperature difference ΔTth (i.e., ΔT0>ΔTth), the printing control unit 100 does not change the rotation speed V (step S112).

In step S107, the speed setting unit 102 calculates the optimum pre-arrival rotation speed $V_A$ using the following equation:

$$V_A = A \times \Delta T0 + B$$

In this equation, A and B are coefficients needed for calculating the optimum pre-arrival rotation speed $V_A$ based on the upper/lower temperature difference ΔT0. The coefficients A and B are determined by experiments. For example, the coefficient A is −1.5, and the coefficient B is 275.

When the requested printing speed Vprn of the fixing roller 64 are both 50 mm/s (corresponding to the rotation speed $V_L$), and when the upper/lower temperature difference ΔT0 is 100° C., the speed-change-decision criterion temperature difference ΔTth [50 mm/s] is 150° C. In this case, the upper/lower temperature difference ΔT0 is smaller than speed-change-decision criterion temperature difference ΔTth (i.e., ΔT0<ΔTth) in step S106, and therefore it is decided that the pre-arrival rotation speed V needs to be changed. From the above described equation, the optimum pre-arrival rotation speed $V_A$ is determined to be −1.5×100+275=125 mm/s in step S107.

Figure 8:
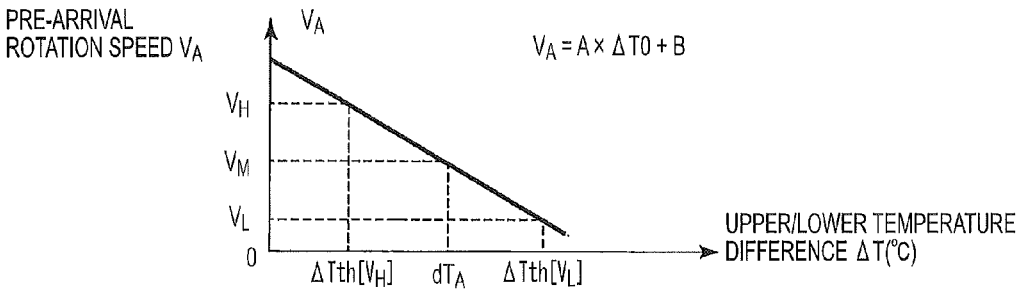
FIG. 8 is a schematic view for illustrating a calculation method of an optimum pre-arrival rotation speed $V_A$ according to the first embodiment.

A calculating method of the optimum pre-arrival rotation speed $V_A$ will be described with reference to FIG. 8. FIG. 8 is a schematic view showing the method of calculating the optimum pre-arrival rotation speed $V_A$ according to the first embodiment. FIG. 8 shows a relationship between the upper/lower temperature difference ΔT0 and the optimum pre-arrival rotation speed $V_A$ providing the optimum heat storage amount $Q_A$. This is obtained by determining the upper/lower temperature differences ΔT0 providing the optimum surface temperature changing amount $D_A$ (see FIG. 7) from the start of rotation for different rotation speeds V. From FIG. 8, it is understood that, as the upper/lower temperature difference ΔT0 becomes smaller, the optimum pre-arrival rotation speed $V_A$ becomes higher (faster).

The optimum pre-arrival rotation speed $V_A$ is determined as described below. It is herein assumed that the upper/lower temperature difference ΔT0 is "$dT_A$" (FIG. 7) and the printing speed is $V_L$ (i.e., a low speed). In this case, the upper/lower temperature difference ΔT0 is smaller than the speed-change-decision criterion temperature difference ΔTth [$V_L$], and therefore it is necessary to increase the heat storage amount by increasing the rotation speed of the fixing roller 64. The rotation speed V required in this case is a middle rotation speed $V_M$ corresponding to $dT_A$ in FIG. 8. It is understood from FIG. 8 that the optimum heat storage amount $Q_A$ is obtained by rotating the fixing roller 64 at the middle rotation speed $V_M$ higher than the low speed $V_L$.

Referring back to FIG. 5, in step S108, an amount of time required for the medium M to reach the fixing unit 6 is calculated based on a position and a feeding speed of the medium M. The calculated time is expressed as $T_{arrive}$. The printing control unit 100 instructs the comparison unit 105 to compare the calculated time $T_{arrive}$ and a predetermined time $T_{const}$. If the calculated time $T_{arrive}$ is smaller than or equal to and the predetermined time $T_{const}$ (i.e., $T_{arrive} \leq T_{const}$), the printing control unit 100 proceeds to step S109.

In this regard, the predetermined time $T_{const}$ is an amount of time in which the temperature of the fixing roller 64 decreases (due to the change in the rotation speed V) and returns to the same temperature as that immediately before the change in the rotation speed V occurs. The predetermined time $T_{const}$ does not depend on the rotation speed V, but is determined based on heat characteristic of the component of the fixing unit 6. For example, the predetermined time $T_{const}$ is 3.0 seconds. In this step S108, a timing of changing the rotation speed V is changed according to the printing speed in order to keep the optimum heat storage amount $Q_A$ (at the start of medium passing) even if the rotation speed V is low.

The reason will be described below. An amount of time after the medium feeding unit 41 starts feeding the medium M and before the medium M starts passing through the fixing unit 6 is different depending on whether the printing speed Vprn is high or low. When the printing speed Vprn is high, the amount of time after the medium feeding unit 41 starts feeding the medium M and before the medium M starts passing through the fixing unit 6 is shorter. Therefore, when the printing speed Vprn is low, if the timing of changing the rotation speed V is performed at the same time when the printing speed Vprn is high, the temperature of the fixing roller 64 may return from the decreased temperature until the medium M starts passing through the fixing unit 6. That is, the temperature of the fixing roller 64 may reach closer to the setting temperature closer than when the printing speed Vrpn is high. As a result, heat input amount P decreases, and the heat storage amount Q at the start of medium passing may decrease.

Therefore, the rotation speed V is changed at different timings depending on the printing speed Vprn. More specifically, the rotation speed of the fixing roller 64 is changed from the printing speed Vprn to the optimum pre-arrival rotation speed $V_A$ at a timing $T_{const}$ before the medium M reaches the fixing unit 6.

In step S109, the speed setting unit 102 sets the rotation speed V of the fixing unit motor 21 to the optimum pre-arrival rotation speed $V_A$ based on the calculation result of the optimum pre-arrival rotation speed $V_A$.

In step S110, the printing control unit 100 decides whether the medium M reaches the fixing unit 6 or not based on output of the writing sensor 8. This is performed as described below.

When the printing control unit 100 detects that a leading edge of the medium M reaches a position of the writing sensor 8 based on change in output of the writing sensor 8, the printing control unit 100 starts counting time. Since a distance (i.e., a medium feeding distance) from the writing sensor 8 to the fixing unit 6 is given, an amount of time required for the medium M to proceed from the position of the writing sensor 8 to the fixing unit 6 is calculated by dividing the given distance by the medium feeding speed. Therefore, by counting the time after the leading edge of the medium M reaches the writing sensor 8, it is possible to detect that the medium M reaches the fixing unit 6.

In step S111, when the printing control unit 100 detects that the medium M reaches the fixing unit 6, the speed setting unit 102 sets the rotation speed V of the fixing unit motor 21 to the printing speed Vprn (i.e., V=Vprn).

Here, although it is described that the speed setting unit 102 sets the rotation speed V of the fixing unit motor 21 to the printing speed Vprn when the medium M reaches the fixing unit 6, this embodiment is not limited to such an arrangement. For example, in step S110, it is also possible that the printing control unit 100 decides whether a predetermined timing before the medium M reaches the fixing unit 6 has come. Then, the printing control unit 100 changes the rotation speed V to the printing speed Vprn. This is advantageous because the amount of time required for the medium to reach the fixing unit 6 (determined by the above described calculation) may include slight error.

In step S112, the printing control unit 100 performs the fixing process.

Using the above described processes, the necessary heat storage amount Q of the fixing roller 64 can be obtained for different printing speeds even when the upper/lower temperature difference ΔT0 is small. Therefore, the temperature of the fixing roller 64 can be prevented from excessively decreasing. As a result, fixing failure can be prevented.

Here, an operation of comparison example will be described. In the comparison example, the rotation speed V of the fixing unit motor 21 is constant (Vprn).

FIGS. 9A through 9F are timing charts showing an operation of the fixing unit 6 of the comparison example when the upper/lower temperature difference ΔT0 is large. FIGS. 9G through 9L are timing charts showing an operation of the fixing unit of the comparison example when the upper/lower temperature difference ΔT0 is small. The printing speed Vprn is set to the low speed $V_L$ (=50 mm/s).

Figures 9A, 9B, 9C, 9D, 9E, 9F, 9G, 9H, 9I, 9J, 9K, 9L:
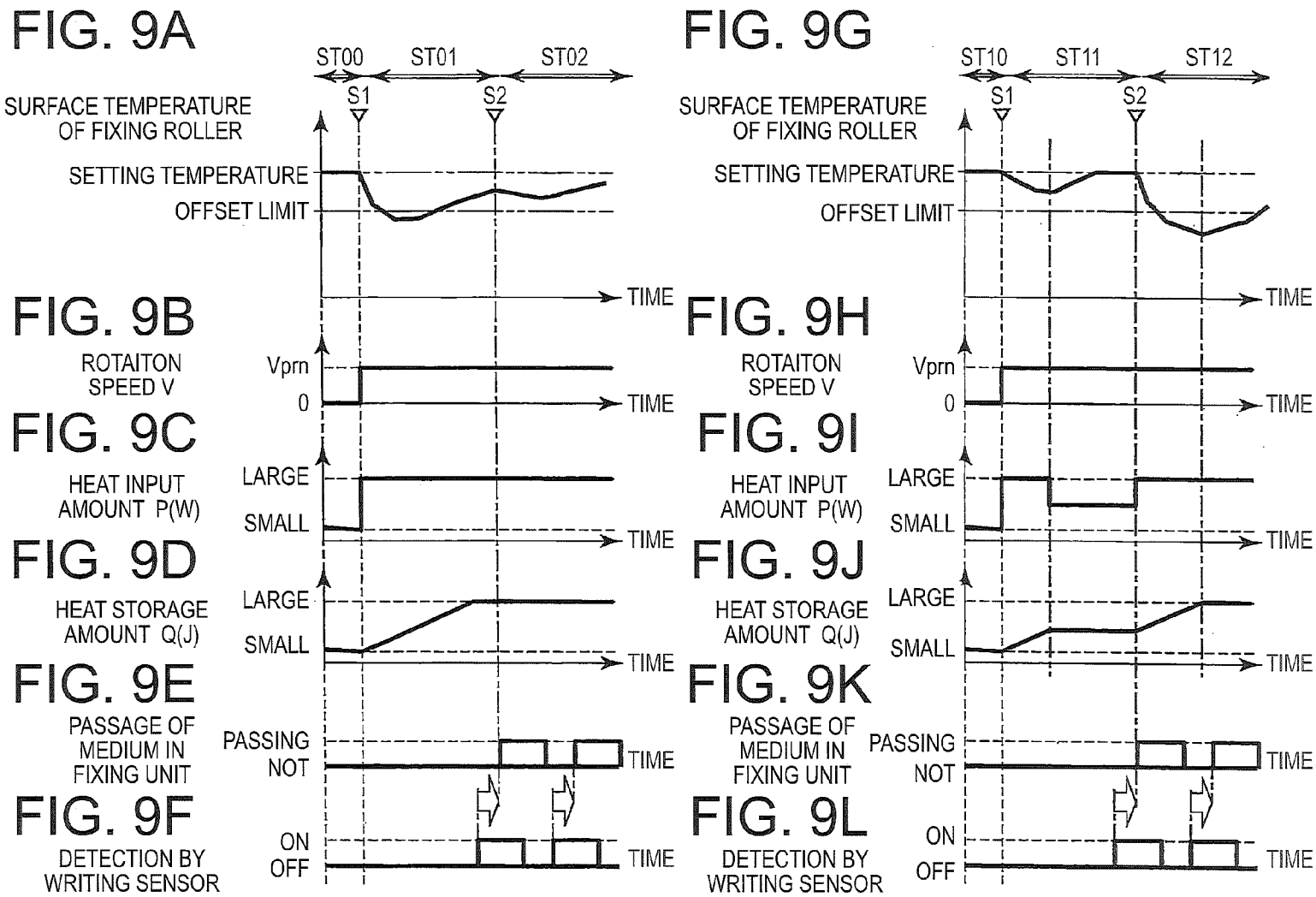
FIGS. 9A through 9F are timing charts showing an operation of a fixing unit of a comparison example when an upper/lower temperature difference ΔT0 is large.
FIGS. 9G through 9L are timing charts showing an operation of the fixing unit of the comparison example when the upper/lower temperature difference ΔT0 is small.

FIGS. 9A and 9G show the surface temperature of the fixing roller 64 detected by the temperature detection unit 103. In FIGS. 9A and 9G, an "offset limit" indicates the lower limit temperature T1 (for example, 175° C.) of the fixing-enabling temperature range. A "setting temperature" indicates the setting temperature $T_{prn}$ (for example, 190° C.) of the fixing-enabling temperature range.

FIGS. 9B and 9H show the rotation speed V of the fixing unit motor 21 controlled by the speed setting unit 102. FIGS. 9C and 9I show the heat input amount P which is input into the fixing roller 64 under control of the heating control unit 104. FIGS. 9D and 9J show the heat storage amount Q of the fixing roller 64. FIGS. 9E and 9K show whether the medium M is passing through the fixing unit 6 or not. FIGS. 9F and 9L show whether the writing sensor 8 detects the medium M (ON) or not (OFF).

In FIGS. 9A through 9L, "ST00" and "ST10" show periods in which the printing control unit 100 detects presence or absence of print command (i.e., the printing control unit 100 is in a standby state). These periods "ST00" and "ST10" correspond to the step S101 in the flowchart of FIG. 5. In these periods "ST00" and "ST10", the fixing unit motor 21 stops, the writing sensor 8 does not detect the medium M, and the medium M does not pass through the fixing unit 6.

Further, in FIGS. 9A through 9L, "S1" indicates a timing when the printing control unit 100 starts rotating the fixing unit motor 21. "S2" indicates a timing when the medium M starts passing through the fixing unit 6. A period ST01 (ST11) starts at the timing S1, and ends at the timing S2. A period ST02 (ST12) starts at the timing S2.

When the printing control unit 100 receives the print command, the printing control unit 100 causes the fixing roller 64 to rotate at the printing speed Vprn. When the fixing roller 64 starts rotation, the surface temperature of the fixing roller 64 decreases as shown in FIGS. 9A and 9G. The fixing roller thermistor 62 detects the decrease in the surface temperature of the fixing roller 64. Then, the printing control unit 100 increases the heat input amount P as shown in FIGS. 9C and 9I. Therefore, the heat storage amount Q increases as shown in FIGS. 9D and 9K. With this, the printing control unit 100 keeps the temperature of the fixing unit 6 at the setting temperature, and performs a fixing process when the medium M reaches the fixing unit 6.

When the upper/lower temperature difference ΔT0 is large as shown in FIGS. 9A through 9F, the decrease in the surface temperature of the fixing roller 64 from the start of rotation (i.e., in the period ST01) is large due to the upper/lower temperature difference ΔT0 even if the rotation speed V (FIG. 9B) is low. The surface temperature of the fixing roller 64 becomes lower than the offset limit as shown in FIG. 9A, and therefore the heat input amount P becomes large as shown in FIG. 9C (in the period ST01). Therefore, when the medium M starts passing through the fixing unit 6, a necessary heat storage amount has been obtained. Further, after the medium M has passed through the fixing unit 6, the surface temperature of the fixing roller 64 shows a small decrease, and is kept within the fixing-enabling temperature. Therefore, fixing failure does not occur in the period ST02.

In contrast, when the upper/lower temperature difference ΔT0 is small as shown in FIGS. 9G through 9L, the decrease in the surface temperature of the fixing roller 64 from the start of rotation (i.e., in the period ST10) is smaller than when the upper/lower temperature difference ΔT0 is large. Therefore, the heat input amount P becomes small as shown in FIG. 91 (in the period ST11). When the medium M starts passing through the fixing unit 6, the heat input amount P becomes larger, and the heat storage amount Q increases. However, since the heat storage amount Q has been small, the necessary heat storage amount is not obtained. Therefore, a necessary heat storage amount is not obtained as shown in FIG. 9J. Further, after the medium M has passed through the fixing unit 6, the surface temperature of the fixing roller 64 largely decreases, and becomes lower than the offset limit (i.e., the lower limit) of the fixing-enabling temperature. As a result, fixing failure occurs in the period ST12.

Next, an example of an operation of the first embodiment will be described.

FIGS. 10A through 10F are timing charts showing an operation of the fixing unit 6 according to the first embodiment when the upper/lower temperature difference ΔT0 is small. FIGS. 10A through 10F are illustrated similarly to FIGS. 9A through 9F. In FIGS. 10A through 10F, "ST20" indicates a period in which the printing control unit 100 detects presence or absence of print command (i.e., the printing control unit 100 is in the standby state) as the periods ST00 and ST10 in FIGS. 9A and 9G. "S1" indicates a timing when the printing control unit 100 starts rotating the fixing unit motor 21. "S2" indicates a timing when the medium M starts passing through the fixing unit 6. A period ST21 starts at the timing S1, and ends at the timing S2. A period ST22 starts at the timing S2.

Figures 10A, 10B, 10C, 10D, 10E, 10F:
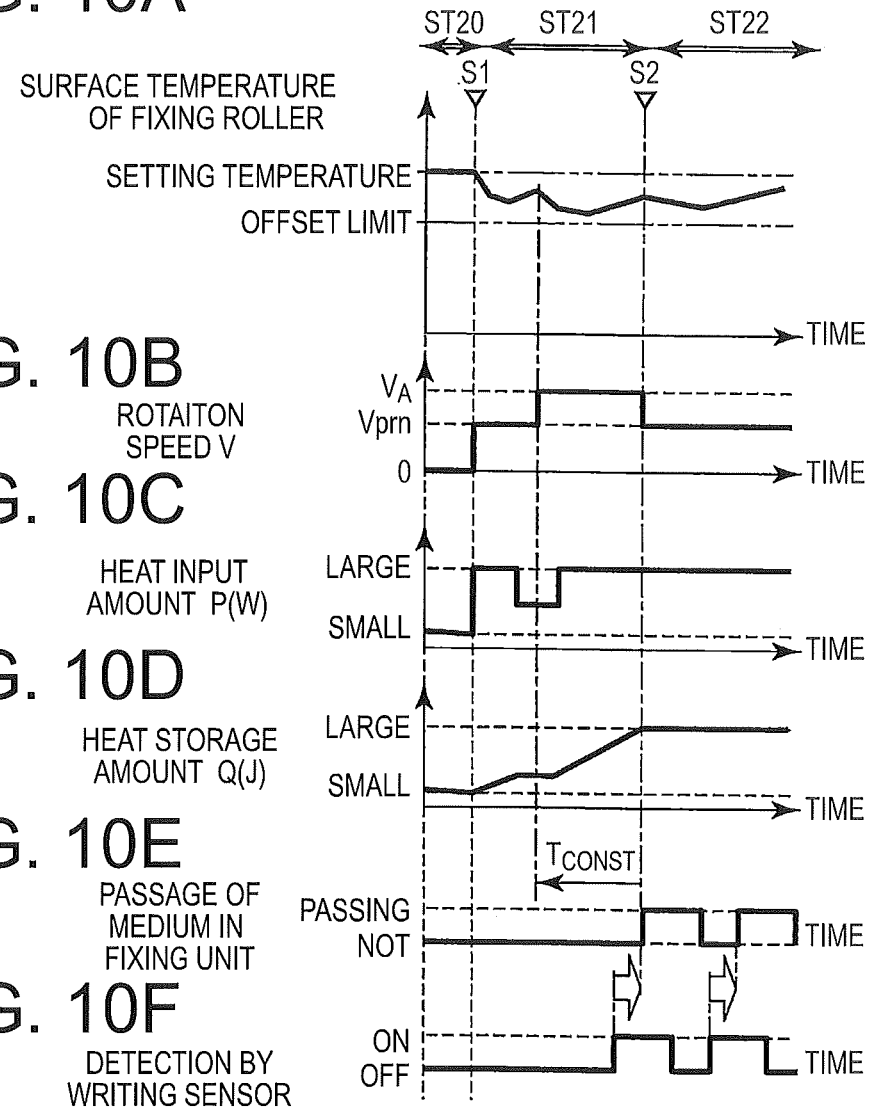
FIGS. 10A through 10F are timing charts showing an operation of the fixing unit according to the first embodiment.

When the printing control unit 100 receives the print command, the printing control unit 100 causes the temperature detection unit 103 to detect the temperatures of the fixing roller 64 and the pressure roller 63. The temperature detection unit 103 detects the temperatures of the fixing roller 64 and the pressure roller 63 by means of the fixing roller thermistor 62 and the pressure roller thermistor 65. As shown in FIG. 10A, the surface temperature of the fixing roller 64 is in the fixing-enabling temperature range in the period ST21. Therefore, according to the instruction from the printing control unit 100, the temperature calculation unit 106 calculates the upper/lower temperature difference ΔT0 based on the temperatures detected by the temperature detection unit 103. Then, the printing control unit 100 selects the speed-change-decision criterion temperature difference ΔTth [Vprn] for deciding whether it is necessary to change the rotation speed V of the fixing unit motor 21.

When the printing control unit 100 decides that it is necessary to change the rotation speed V, the speed setting unit 102 calculates the optimum pre-arrival rotation speed $V_A$ based on the selected speed-change-decision criterion temperature difference ΔTth and the printing speed. The printing control unit 100 causes the speed setting unit 102 to rotate the fixing roller 64 at the rotation speed Vprn (i.e., a first rotation speed) (FIG. 10B). Further, the printing control unit 100 causes the heating control unit 104 to control the heater power source 16 so as to bring the surface temperature of the fixing roller 64 within the fixing-enabling temperature.

When a remaining time before the medium M reaches the fixing unit 6 becomes less than or equal to $T_{const}$, the motor control unit 101 causes the fixing unit motor 21 to rotate at the optimum pre-arrival rotation speed $V_A$ (i.e., a second rotation speed) set by the speed setting unit 102. The rotation speed $V_A$ (FIG. 10B) is sufficiently high, and therefore the heat input amount P becomes large as shown in FIG. 10C, and the sufficient heat storage amount Q at the start of medium passing is obtained as shown in FIG. 10D (in a period ST21). This can be understood from the relationship shown in FIG. 7.

Thereafter, when the printing control unit 100 detects that the medium M reaches the fixing unit 6, the speed setting unit 102 causes the motor control unit 101 to change the rotation speed V (FIG. 10B) of the fixing unit motor 21 to the printing speed Vprn. As a result, necessary and sufficient heat storage amount Q at the start of medium passing can be obtained. Therefore, even if the amount of heat transferred from the fixing roller 64 to the medium M becomes large immediately after the medium M starts passing through the fixing unit 6, the decrease in the surface temperature of the fixing roller 64 can be suppressed. Therefore, fixing failure can be prevented in the period ST22.

As described above, according to the first embodiment of the present invention, the decrease in the temperature of the fixing roller 64 immediately after the medium M starts passing through the fixing unit 6 can be suppressed. Accordingly, the printing failure can be prevented even when the upper/lower temperature difference ΔT0 is small.

Second Embodiment

Figure 11:
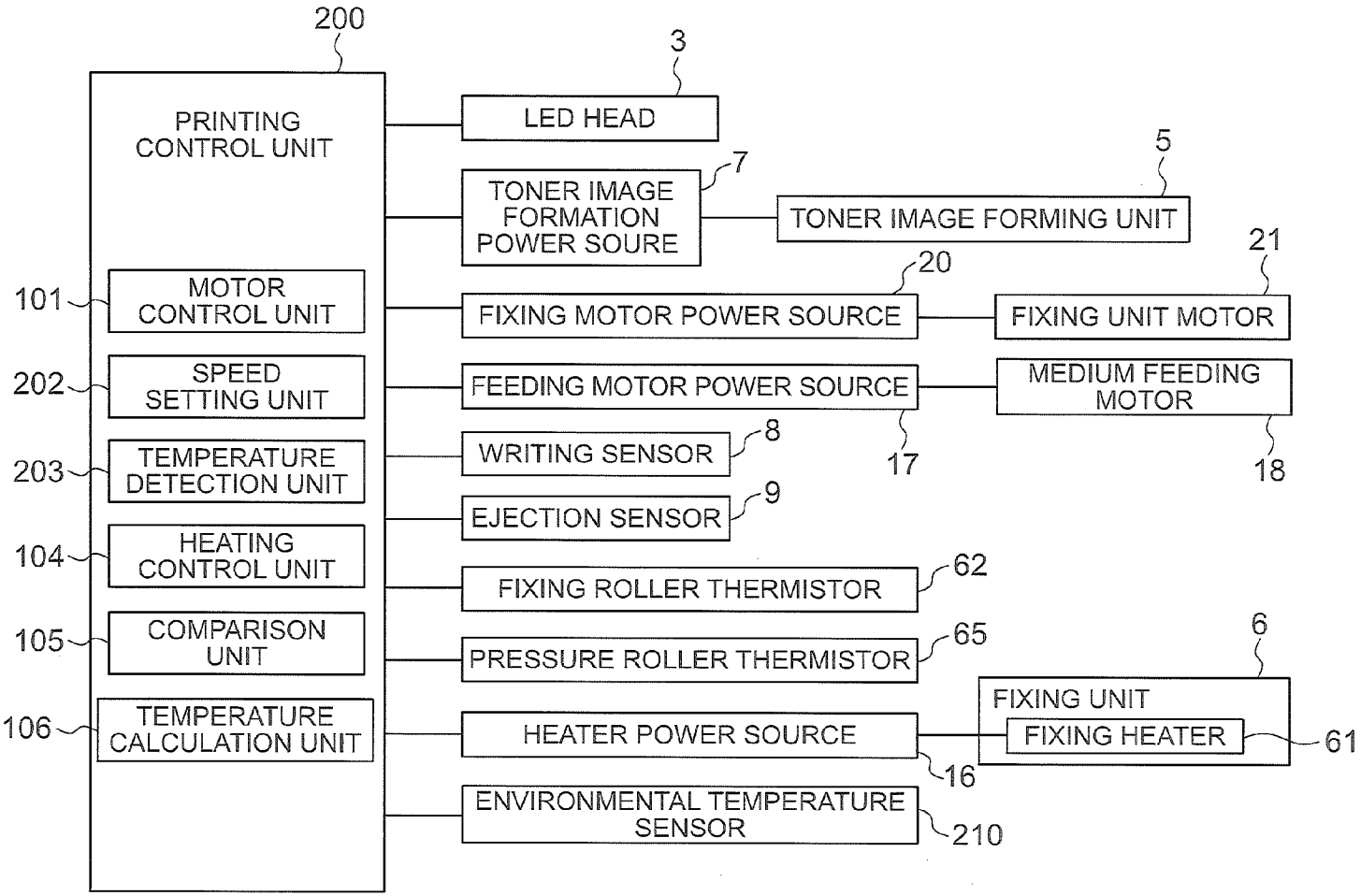
FIG. 11 is a block diagram showing a control system of an image forming apparatus according to the second embodiment of the present invention.

FIG. 11 is a block diagram showing a control system of an image forming apparatus according to the second embodiment of the present invention. In the second embodiment, components that are the same as those of the first embodiment are assigned the same reference numerals. The image forming apparatus of the second embodiment is different from that of the first embodiment in the printing control unit 200. More specifically, the printing control unit 200 employs a different speed setting method from that of the printing control unit 100 of the first embodiment. The printing control 200 includes a speed setting unit 202 which is different from the speed setting unit 102 of the first embodiment. Further, unlike the image forming apparatus of the first embodiment, the image forming apparatus of the second embodiment includes an environmental temperature sensor 210 as an environmental temperature detection unit (i.e., a third temperature detection unit).

The environmental temperature sensor 210 is mounted in the image forming apparatus 1, and is connected to a temperature detection unit 203 of the printing control unit 200. The environmental temperature sensor 210 detects the temperature in the image forming apparatus 1. The temperature detection unit 203 receives information on the surface temperatures of the fixing roller 64 and the pressure roller 63 from the fixing roller thermistor 62 and the pressure roller thermistor 65, and also receives information on the temperature in the image forming apparatus 1 from the environmental temperature sensor 210. Other components of the second embodiment are the same as those of the first embodiment.

Figure 12:
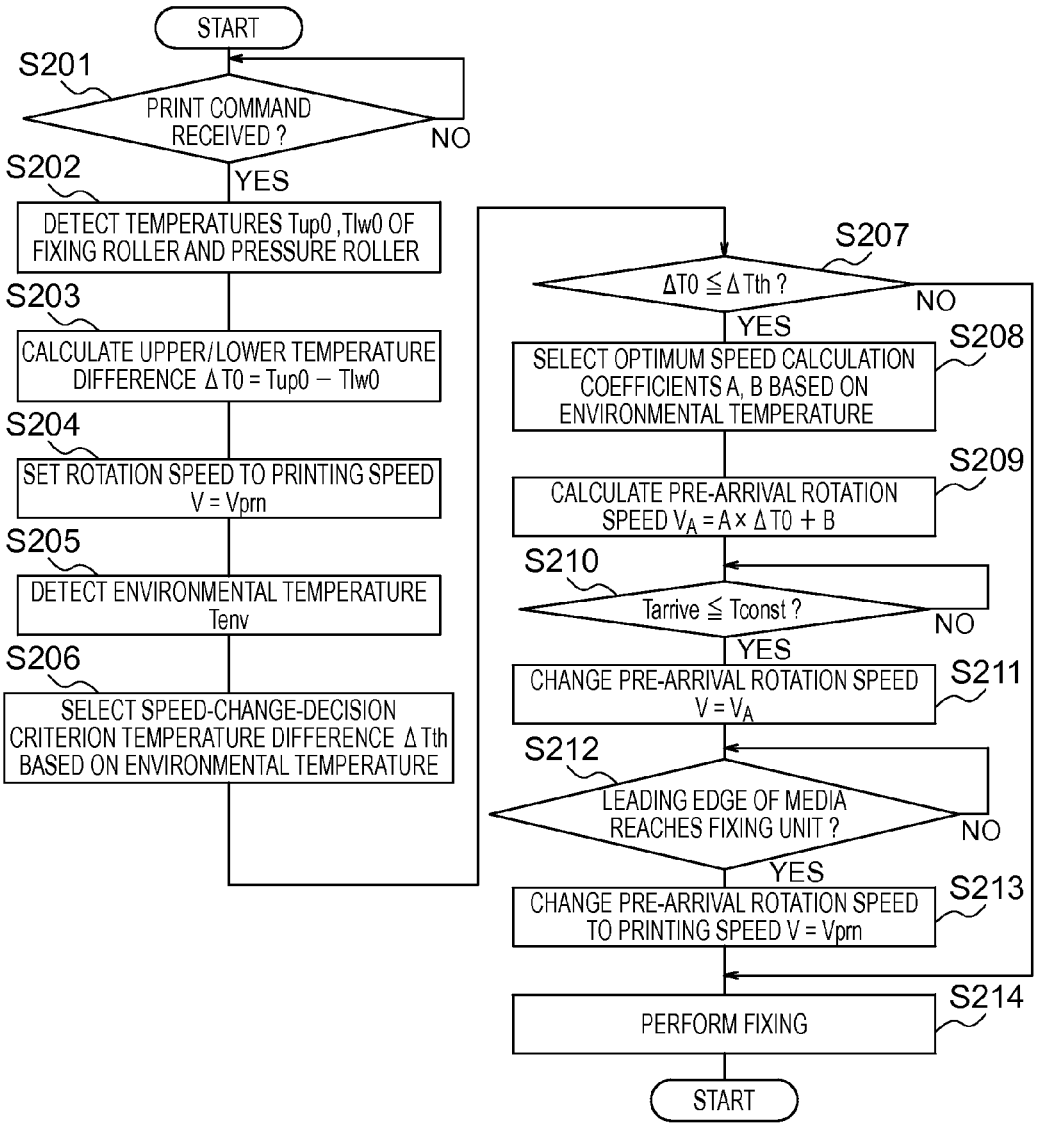
FIG. 12 is a flowchart showing an operation for controlling a rotation speed of a fixing unit motor according to the second embodiment.

FIG. 12 is a flowchart showing an operation for controlling the rotation speed of the fixing unit motor 21 according to the second embodiment. The operation of the second embodiment will be described with reference to FIG. 12. Steps S201, S202, S203 and S204 are the same as the steps S101, S102, S103 and S104, and explanations thereof are omitted.

In step S205, the temperature detection unit 203 of the printing control unit 200 obtains an environmental temperature Tenv (i.e., a detection result) from the environmental temperature sensor 210.

In step S206, the printing control unit 200 selects the speed-change-decision criterion temperature difference ΔTth corresponding to the environmental temperature Tenv in order to decide whether it is necessary to change the rotation speed V of the fixing unit motor 21.

When the environmental temperature Tenv is high (for example, higher than or equal to 30° C.), the printing control unit 200 selects a speed-change-decision criterion temperature difference ΔTth1 [Vprn].

When the environmental temperature Tenv is normal (for example, higher than or equal to 15° C. but lower than 30° C.), the printing control unit 200 selects a speed-change-decision criterion temperature difference ΔTth2 [Vprn].

When the environmental temperature Tenv is low (for example, lower than 15° C.), the printing control unit 200 selects a speed-change-decision criterion temperature difference ΔTth3 [Vprn].

The speed-change-decision criterion temperature differences ΔTth1, ΔTth2 and ΔTth3 are determined by experiments.

For example, when the rotation speed V is 200 mm/s, the speed-change-decision criterion temperature difference ΔTth1 [200 mm/s] is 20° C. When the rotation speed V is 125 mm/s, the speed-change-decision criterion temperature difference ΔTth1 [125 mm/s] is 50° C. When the rotation speed V is 50 mm/s, the speed-change-decision criterion temperature difference ΔTth1 [50 mm/s] is 80° C.

Further, when the rotation speed V is 200 mm/s, the speed-change-decision criterion temperature difference ΔTth2 [200 mm/s] is 50° C. When the rotation speed V is 125 mm/s, the speed-change-decision criterion temperature difference ΔTth2 [125 mm/s] is 100° C. When the rotation speed V is 50 mm/s, the speed-change-decision criterion temperature difference ΔTth2 [50 mm/s] is 150° C.

Further, when the rotation speed V is 200 mm/s, the speed-change-decision criterion temperature difference ΔTth3 [200 mm/s] is 90° C. When the rotation speed V is 125 mm/s, the speed-change-decision criterion temperature difference ΔTth3 [125 mm/s] is 150° C. When the rotation speed V is 50 mm/s, the speed-change-decision criterion temperature difference ΔTth3 [50 mm/s] is 210° C.

Here, the speed-change-decision criterion temperature difference ΔTth will be described with reference to FIGS. 13 and 14.

Figure 13:
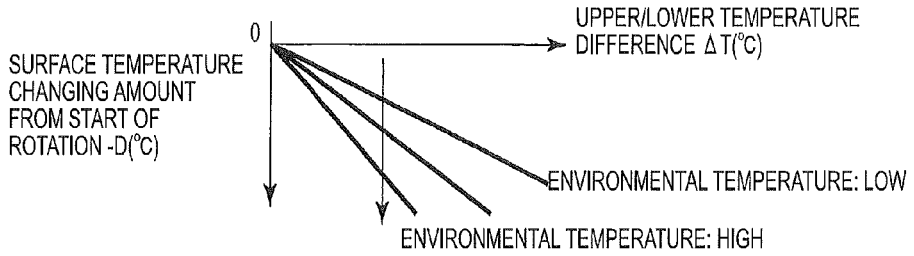
FIG. 13 is a schematic view for illustrating a relationship between a heat storage amount Q at start of medium passing and a surface temperature changing amount D from start of rotation for different environmental temperatures according to the second embodiment.

FIG. 13 is a schematic view for illustrating a relationship between a heat storage amount Q at the start of medium passing and a surface temperature changing amount D from the start of rotation of the fixing roller 64 for different environmental temperatures. The environmental temperature is considered to be almost the same as a temperature of the medium M. When the temperature of the medium M is low, the temperature difference between the medium M and the fixing roller 64 is larger than when the temperature of the medium M is high. Therefore, an amount of heat transferred from the fixing roller 64 to the medium M per unit time becomes larger, and the temperature of the fixing roller 64 tends to decrease largely. Accordingly, for the same heat storage amount Q, when the temperature of the medium M is low, the surface temperature of the fixing roller 64 largely decreases than when the temperature of the medium M is high.

Figure 14:
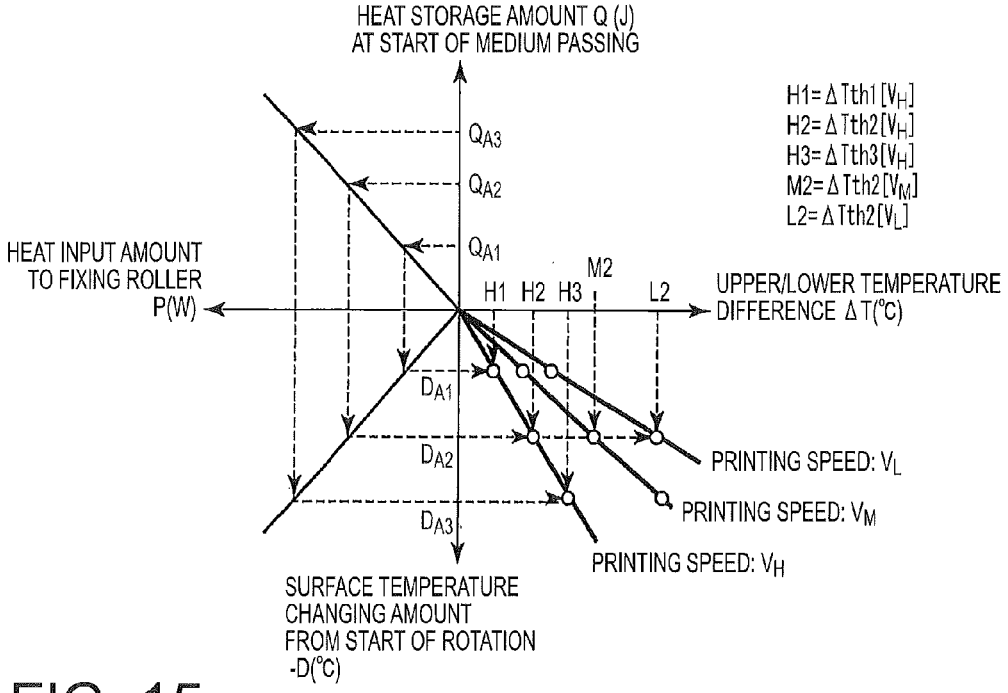
FIG. 14 is a schematic view for illustrating a relationship among an upper/lower temperature difference ΔT0, the surface temperature changing amount D from start of rotation, a heat input amount P, the heat storage amount Q at start of medium passing, and a speed-change-decision criterion temperature difference ΔTth according to the second embodiment.

FIG. 14 is a schematic view showing a relationship between the upper/lower temperature difference ΔT0, the surface temperature changing amount D from the start of rotation, the heat input amount P, the heat storage amount Q at the start of medium passing, and the speed-change-decision criterion temperature difference ΔTth. As compared with FIG. 7 described in the first embodiment, FIG. 14 shows that the heat storage amount Q of the fixing roller 64 varies depending on the temperature of the medium M (i.e., the environmental temperature). In this regard, FIG. 7 of the first embodiment shows the optimum heat storage amount $Q_A$ when the temperature of the medium M is normal. FIG. 14 shows the optimum heat storage amounts $Q_A$ when the temperature of the medium M is low, normal and high.

In order that the temperature changes after the medium M has passed through the fixing unit 6 are the same, a larger heat storage amount Q is needed when the temperature of the medium M is low than when the temperature of the medium M is high (i.e., $Q_{A1}<Q_{A3}$). As a result, the speed-change-decision criterion temperature difference ΔTth differs depending on the temperatures of the medium M.

In FIG. 14, H1 represents ΔTth1 [$V_H$], H2 represents ΔTth2 [$V_H$], and H3 represents ΔTth3 [$V_H$]. Further, M2 represents ΔTth2 [$V_M$], and L2 represents ΔTth2 [$V_L$]. In the example of FIG. 14, the following relationship is satisfied: H1<H2<H3<M2<L2. That is, the speed-change-decision criterion temperature difference ΔTth differs depending on the printing speed $V_L$, $V_M$ and $V_H$. In this way, the speed-change-decision criterion temperature difference ΔTth [Vprn] corresponding to the printing speed Vprn can be determined.

Referring back to FIG. 12, in step S207, the printing control unit 200 causes the comparison unit 105 to compare the upper/lower temperature difference ΔT0 (calculated by the temperature difference calculation unit 106) and the speed-change-decision criterion temperature difference ΔTth selected by the printing control unit 200.

When the upper/lower temperature difference ΔT0 is smaller than or equal to the speed-change-decision criterion temperature difference ΔTth [Vprn, Tenv] (i.e., ΔT0≤ΔTth [Vprn, Tenv]), the printing control unit 200 changes the rotation speed (steps S208 through S213).

When the upper/lower temperature difference ΔT0 is larger than the speed-change-decision criterion temperature difference ΔTth [Vprn, Tenv] (i.e., ΔT0>ΔTth [Vprn, Tenv]), the printing control unit 200 does not change the rotation speed (step S214).

In step S208, the printing control unit 200 selects optimum speed calculation coefficients A and B based on the environmental temperature Tenv. The speed setting unit 202 calculates the optimum pre-arrival rotation speed $V_A$ using an equation (step S209). The equation is selected based on the environmental temperature among the following equations respectively determining the optimum pre-arrival rotation speeds $V_{A1}$, $V_{A2}$ and $V_{A3}$.

When the environmental temperature is high, the following equation is provided: $V_{A1}$=A1×ΔT0+B1.

When the environmental temperature is normal, the following equation is provided: $V_{A2}$=A2×ΔT0+B2.

When the environmental temperature is low, the following equation is provided: $V_{A3}$=A3×ΔT0+B3.

The speed calculation coefficients A1, B1, A2, B2, A3 and B3 are determined by experiments. For example, A1 is −2.5, B1 is 250, A2 is −1.5, B2 is 200, A3 is −1.25, and B3 is 312.5.

Steps S209 through S214 are the same as the steps S107 through S112 of the first embodiment, and explanations thereof are omitted.

Figure 15:
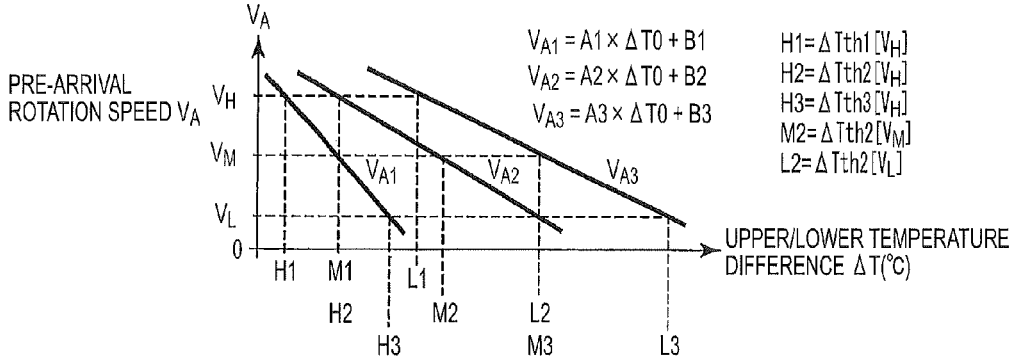
FIG. 15 is a schematic view for illustrating a method for calculating an optimum pre-arrival rotation speed $V_{A1}$, $V_{A2}$ or $V_{A3}$ for different environmental temperatures according to the second embodiment.

FIG. 15 is a schematic view showing a method of calculating the optimum pre-arrival rotation speed $V_{A1}$, $V_{A2}$ and $V_{A3}$ for different environmental temperatures according to the second embodiment. FIG. 15 shows a relationship between the upper/lower temperature difference ΔT0 and the optimum pre-arrival rotation speed $V_{A1}$, $V_{A2}$ and $V_{A3}$ under the condition that the optimum heat storage amounts $Q_{A1}$, $Q_{A2}$ and $Q_{A3}$ are obtained for respective environmental temperatures. This is obtained by determining upper/lower temperature differences ΔT0 that provides the surface temperature changing amounts $D_{A1}$, $D_{A2}$ and $D_{A3}$ (from the start of rotation of the fixing roller 64) for respective rotation speeds in FIG. 14. From FIG. 15, it is understood that the pre-arrival rotation speed $V_A$ becomes higher (faster) as the environmental temperature in the image forming apparatus 1 detected by the environmental temperature sensor 210 becomes lower. Other processes are the same as those of the first embodiment, and explanations thereof are omitted.

The operation of the second embodiment will be described with reference to FIGS. 16A through 16L. FIGS. 16A through 16F are timing charts showing operations under a low temperature and low humidity environment (i.e., an LL environment) according to the second embodiment. FIGS. 16G through 16L are timing charts showing operations under a high temperature and high humidity environment (i.e., an HH environment) according to the second embodiment. In FIGS. 16A through 16F, the upper/lower temperature difference ΔT0 is small as described with reference to FIGS. 9A through 9F. FIGS. 16A through 16L are illustrated similarly to FIGS. 9A through 9L.

In FIGS. 16A through 16L, "ST50" and "ST60" indicate periods in which the printing control unit 200 detects presence or absence of print command (i.e., the image forming apparatus is in the standby state), and correspond to the step S201 in the flowchart of FIG. 12. Further, "S1" indicates a timing when the printing control unit 200 starts rotating the fixing unit motor 21. "S2" indicates a timing when the medium M starts passing through the fixing unit 6. A period ST51 (ST61) starts at the timing S1, and ends at the timing S2. A period ST52 (ST62) starts at the timing S2.

Figures 16A, 16B, 16C, 16D, 16E, 16F, 16G, 16H, 16I, 16J, 16K, 16L:
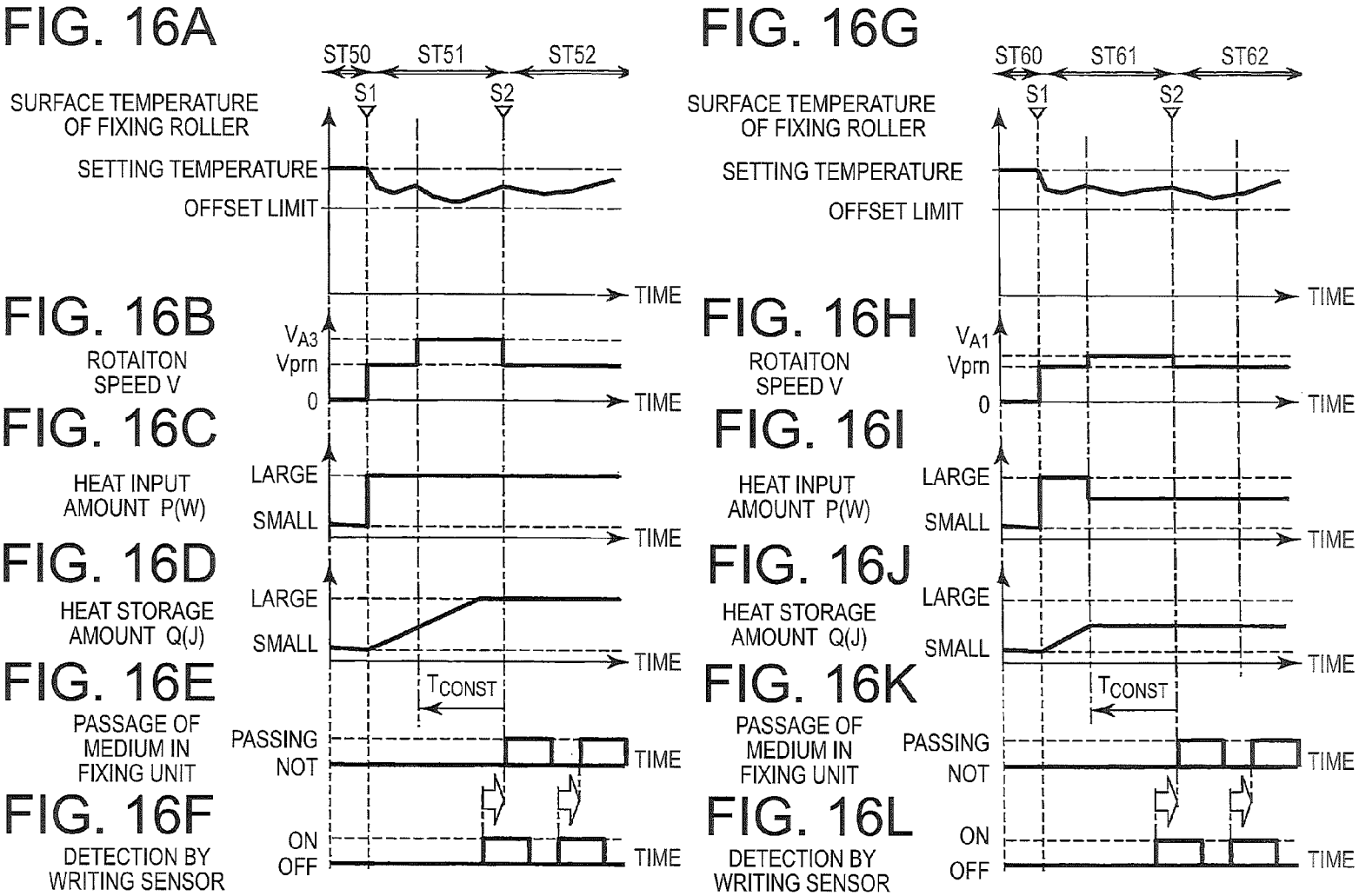
FIGS. 16A through 16F are timing charts showing an operation of the fixing unit according to the second embodiment under low temperature and low humidity environment.
FIGS. 16G through 16L are timing charts showing an operation of the fixing unit according to the second embodiment under high temperature and high humidity environment.

When the printing control unit 200 receives the print command, the printing control unit 200 causes the temperature detection unit 203 to detect the temperatures of the fixing roller 64 and the pressure roller 63. The temperature detection unit 203 detects the temperatures of the fixing roller 64 and the pressure roller 63 by means of the fixing roller thermistor 62 and the pressure roller thermistor 65. As shown in FIGS. 16A and 16G, the surface temperature of the fixing roller 64 is in the fixing-enabling temperature range in the period ST51 (ST61). Therefore, according to the instruction from the printing control unit 200, the temperature calculation unit 106 calculates the upper/lower temperature difference ΔT0 based on the temperatures detected by the temperature detection unit 203. Then, the printing control unit 200 selects the speed-change-decision criterion temperature difference ΔTth [Vprn] for deciding whether it is necessary to change the rotation speed V of the fixing unit motor 21. When the printing control unit 200 decides that it is necessary to change the rotation speed V, the speed setting unit 202 calculates the optimum pre-arrival rotation speed $V_A$ based on the selected speed-change-decision criterion temperature difference ΔTth and the printing speed.

Then, the printing control unit 200 causes the speed setting unit 202 to rotate the fixing roller 64 at the rotation speed Vprn (FIGS. 16B and 16H). Further, the printing control unit 200 causes the heating control unit 204 to control the heater power source 16 so as to bring the surface temperature of the fixing roller 64 within the fixing-enabling temperature (FIGS. 16A and 16G). When a remaining time before the medium M reaches the fixing unit 6 becomes less than or equal to $T_{const}$, the motor control unit 101 causes the fixing unit motor 21 to rotate at the optimum pre-arrival rotation speed $V_A$ set by the speed setting unit 202.

The rotation speed $V_{A3}$ (FIG. 16B) is sufficiently high, and therefore the surface temperature changing amount D from the start of rotation of the fixing roller 64 increases. Therefore, the heat input amount P becomes large (periods ST51 and ST61). In this regard, a larger heat storage amount is needed under the low temperature and low humidity environment (FIG. 16D) than under the high temperature and high humidity environment (FIG. 16J). Therefore, the optimum pre-arrival rotation speed $V_{A3}$ under the low temperature and low humidity environment (FIG. 16B) is higher than the optimum pre-arrival rotation speed $V_{A1}$ under the high temperature and high humidity environment (FIG. 16H). In other words, the heat input amount P under the low temperature and low humidity environment (FIG. 16C) is larger than under the high temperature and high humidity environment (FIG. 16I).

Thereafter, when the printing control unit 200 detects that the medium M reaches the fixing unit 6 based on the detection result of the writing sensor 8, the speed setting unit 202 causes the motor control unit 101 to change the rotation speed V (FIGS. 16B and 16H) of the fixing unit motor 21 to the printing speed Vprn. Then, the medium M starts to be fed through the fixing unit 6.

In this regard, the heat storage amount Q under the low temperature and low humidity environment (FIG. 16D) is larger than the heat storage amount Q under the high temperature and high humidity environment (FIG. 16J) as described above. Therefore, even if the heat transferred from the fixing roller 64 to the medium M increases due to the low temperature of the medium M, the decrease in the temperature of the fixing roller 64 can be substantially the same as under the high temperature and high humidity environment. As a result, the decrease in the temperature of the fixing roller 64 immediately after the medium M starts passing through the fixing unit 6 can be reduced. That is, fixing failure can be prevented.

Modification 1.

In the second embodiment, the target rotation speed V is changed based on the optimum heat storage amount Q corresponding to the environmental temperature (which is considered to be substantially the same as the temperature of the medium M). In this regard, it is also effective in preventing fixing failure to change the optimum heat storage amount Q and the target rotation speed V based on a thickness of the medium M. It is herein assumed that the environmental temperature is made constant.

Figure 17:
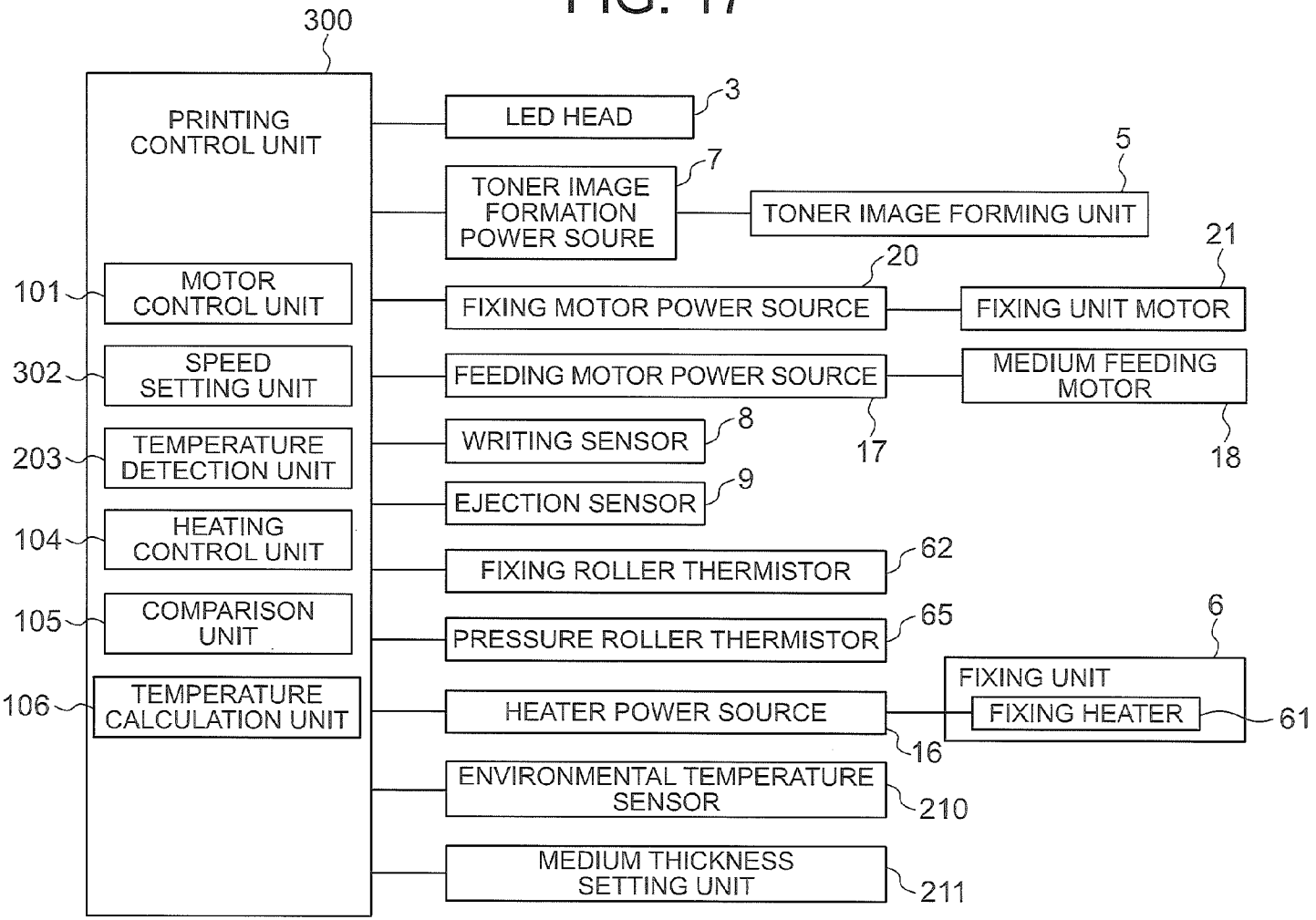
FIG. 17 is a block diagram showing a control system of an image forming apparatus according to Modification 1 of the second embodiment.

FIG. 17 is a block diagram showing a control system of an image forming apparatus 1 according to Modification 1 of the second embodiment. The image forming apparatus 1 of Modification 1 includes a medium thickness setting unit 211 for setting the thickness of the medium M on which printing is to be performed. The medium thickness setting unit 211 is connected to a printing control unit 300. The medium thickness setting unit 211 includes an input unit (i.e., an operation unit) operated by an operator. The input unit includes buttons for designating one of a thin medium (i.e., a thin sheet) and a thick medium (i.e., a thick sheet). The operator can set the thickness of the medium by pressing the thin medium button or the thick medium button of the medium thickness setting unit 211. Alternatively, in the case where the print command sent from the host device (i.e., a host controller) includes information on the thickness of the medium M, the medium thickness setting unit 211 can be mounted in the printing control unit 300 and can be configured to detect the thickness of the medium M based on the print command. Furthermore, the medium thickness setting unit 211 can be configured to automatically detect the thickness of the medium M using a thickness sensor (for example, a pair of rollers between which the medium M is nipped).

Figure 18:
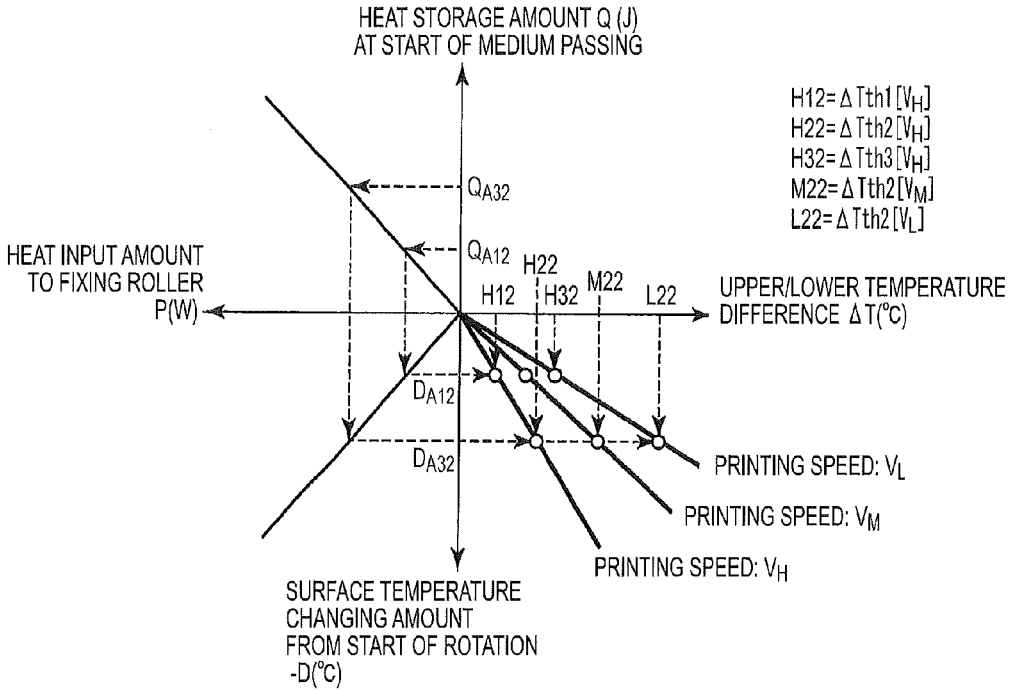
FIG. 18 is a schematic view for illustrating a relationship among an upper/lower temperature difference ΔT0, a surface temperature changing amount D from start of rotation, a heat input amount P, a heat storage amount Q at start of medium passing, and a speed-change-decision criterion temperature difference ΔTth according to Modification 1 of the second embodiment.

A speed setting unit 302 mounted in the printing control unit 300 is different from the speed setting unit 202 of the second embodiment. The speed setting unit 302 controls the rotation speed V based on the optimum heat storage amount Q that changes according to the thickness of the medium M as shown in FIG. 18. Therefore, it becomes possible to keep constant the decrease in the temperature of the fixing roller 64 after the medium M starts passing through the fixing unit 6 irrespective of the thickness of the medium M. Since the medium M has a constant surface area defined by international standard (for example, A4 size), a volume of the medium M increases as the thickness of the medium M increases. As the volume of the medium M increases, a heat capacity of the medium M also increases. As the heat capacity of the medium M increases, an amount of heat transferring from the fixing roller 64 to the medium M also increase, and therefore decrease in the temperature of the fixing roller 64 becomes larger.

Therefore, in Modification 1, the rotation speed V is changed due to the thickness of the medium M. To be more specific, even if the upper/lower temperature difference ΔT0 is the same, the rotation speed V is set higher as the medium M becomes thicker. This increases the heat storage amount Q of the fixing roller 64 at start of medium passing (i.e., when the medium M start passing through the fixing unit 6), with the result that the decrease in the temperature of the fixing roller 64 is reduced.

FIG. 18 is a schematic view showing the upper/lower temperature difference ΔT0, the surface temperature changing amount D from the start of rotation, the heat input amount P, the heat storage amount Q at the start of medium passing, and the speed-change-decision criterion temperature difference ΔTth according to Modification 1. FIG. 18 shows that necessary heat storage amount Q of the fixing roller 64 shown in FIG. 7 of the first embodiment varies depending on the thickness of the medium M. FIG. 7 of the first embodiment shows the optimum heat storage amount $Q_A$ when the medium M is a thin sheet. In contrast, FIG. 18 shows the heat storage amount $Q_{A12}$ when the medium M is a thin sheet and the heat storage amount $Q_{A32}$ when the medium M is a thick sheet.

In order to keep constant the surface temperature changing amount D from the start of rotation of the fixing roller 64, the necessary heat storage amount $Q_{A12}$ when the medium M is thick is larger than the necessary heat storage amount $Q_{A32}$ when the medium M is thin (i.e. n (i.e., $Q_{A12}<Q_{A32}$). Therefore, the speed-change-decision criterion temperature difference ΔTth when the medium M is thick is different from the speed-change-decision criterion temperature difference ΔTth when the medium M is thin.

In FIG. 18, H12 represents ΔTth1 [$V_H$], H22 represents ΔTth2 [$V_H$], and H32 represents ΔTth3 [$V_H$]. Further, M22 represents ΔTth2 [$V_M$], and L22 represents ΔTth2 [$V_L$]. In the example shown in FIG. 18, the following relationship is satisfied: H12<H22<H32<M22<L22. That is, the speed-change-decision criterion temperature difference ΔTth differs depending on the printing speed $V_H$, $V_M$ or $V_L$.

In this way, the speed-change-decision criterion temperature difference ΔTth [Vprn] corresponding to the printing speed (rotation speed) can be determined.

Modification 2.

It is also effective in preventing fixing failure to change the target rotation speed V and the optimum heat storage amount Q based on the number of the media M on which printing is to be performed. It is herein assumed that the environmental temperature and the thickness of the medium M are respectively made constant.

Figure 19:
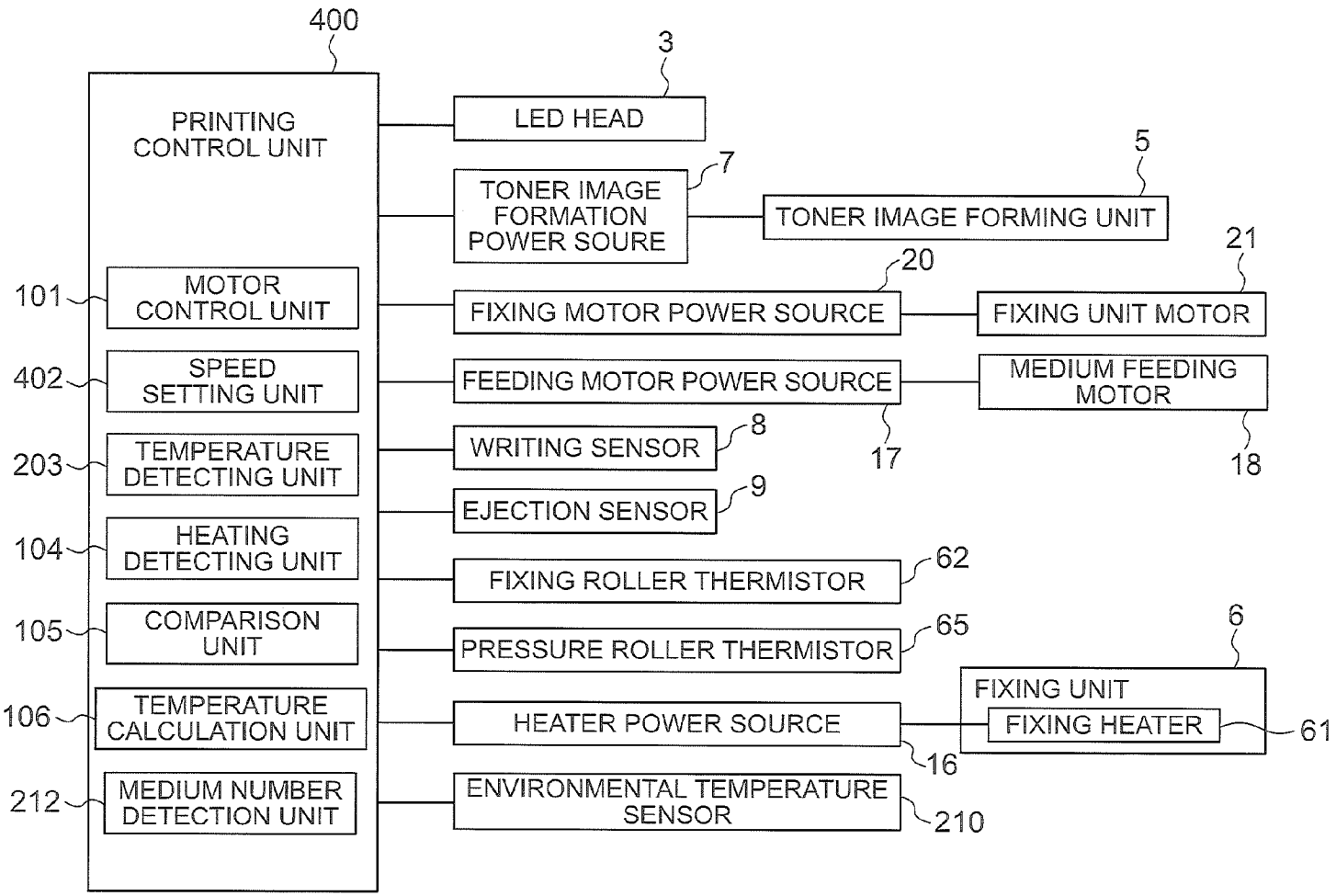
FIG. 19 is a block diagram showing a control system of an image forming apparatus according to Modification 2 of the second embodiment.

FIG. 19 is a block diagram showing a control system of an image forming apparatus 1 according to Modification 2 of the second embodiment. The image forming apparatus 1 of Modification 2 includes a medium number detection unit 212 for detecting the number of the media M on which printing is to be performed. The medium number detection unit 212 is mounted in a printing control unit 400. When the print command sent from the host device (i.e., the host computer) includes information on the number of the media M on which printing is to be performed, the medium number detection unit 212 detects the number of the media M based on the print command. Alternatively, the medium number detection unit 212 can have an input unit (i.e., an operation unit) operated by an operator, and the input unit can have a button (i.e., a number setting button) for setting the number of the media M. In such a case, the medium number detection unit 212 can detect the number of the media M based on the user's operation of the number setting button.

Figure 20:
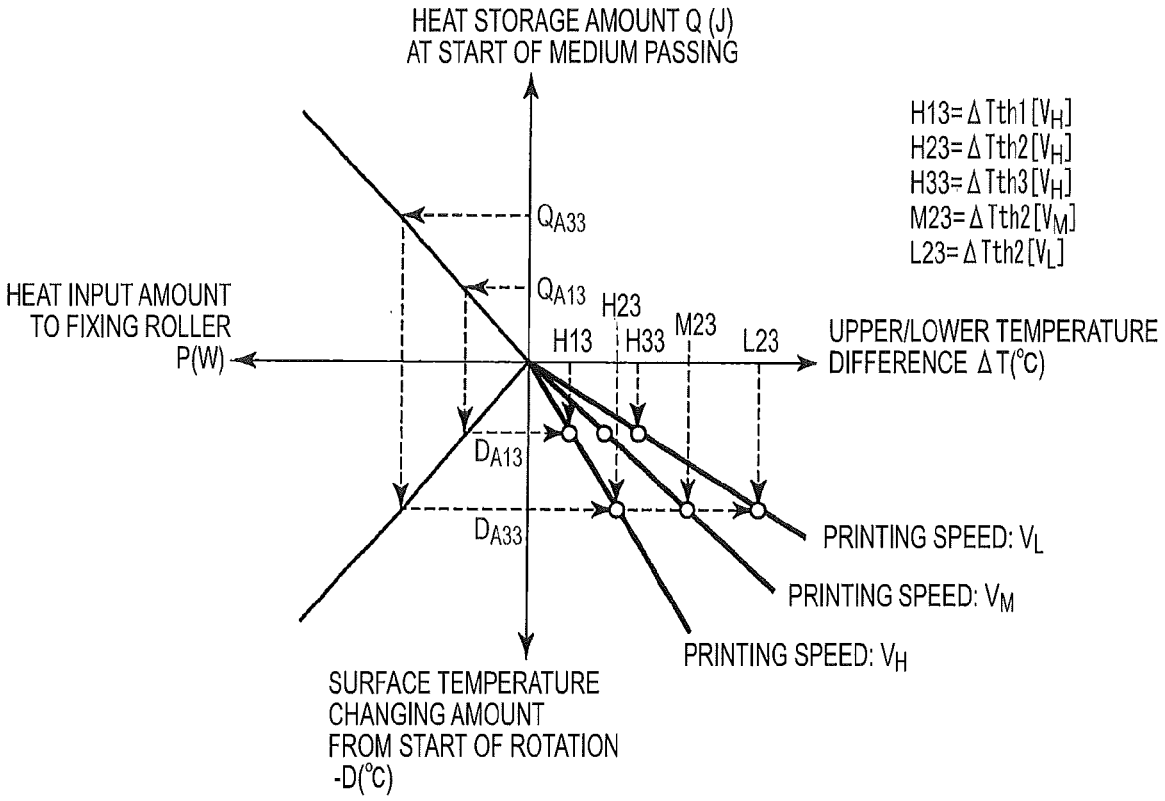
FIG. 20 is a schematic view for illustrating a relationship among an upper/lower temperature difference ΔT0, a surface temperature changing amount D from start of rotation, a heat input amount P, a heat storage amount Q at a start of medium passing, and a speed-change-decision criterion temperature difference ΔTth according to Modification 2 of the second embodiment.

A speed setting unit 402 mounted in the printing control unit 400 is different from the speed setting unit 202 of the second embodiment. The speed setting unit 402 controls the rotation speed V based on the optimum heat storage amount Q that changes according to the number of the media M as shown in FIG. 20. Therefore, it becomes possible to keep constant the decrease in the temperature of the fixing roller 64 after the medium M starts passing through the fixing unit 6 irrespective of the number of the media M. As the number of the media M on which printing is continuously performed increases, an amount of heat drawn from the fixing roller 64 increases. Therefore, an amount of heat (needed for fixing images) increases as the number of media M increases. Further, since it takes time for the heat (generated by the fixing heater 61) to reach the surface of the fixing roller 64 as described above, the temperature of the fixing roller 64 tends to further decrease.

Therefore, in Modification 2, the rotation speed V is controlled based on the number of media M on which printing is to be continuously performed. To be more specific, even if the upper/lower temperature difference ΔT0 is the same, the rotation speed V is set higher as the number of media M increases. This increases the heat storage amount Q at the start of medium passing, with the result that the decrease in the temperature of the fixing roller 64 is reduced.

FIG. 20 is a schematic view showing the upper/lower temperature difference ΔT0, the surface temperature changing amount D from the start of rotation, the heat input amount P, the heat storage amount Q at the start of medium passing, and the speed-change-decision criterion temperature difference ΔTth according to Modification 2. FIG. 20 shows that necessary heat storage amount Q of the fixing roller 64 shown in FIG. 7 of the first embodiment varies depending on the number of the media M. FIG. 7 of the first embodiment shows the optimum heat storage amount $Q_A$ when the number of media M is 1. In contrast, FIG. 20 shows the heat storage amount $Q_{A13}$ when the number of the media M is 1 and the heat storage amount $Q_{A33}$ when the number of the media M is 10 or more.

In order to keep constant the surface temperature changing amount D from the start of rotation of the fixing roller 64, the necessary heat storage amount $Q_{A33}$ when the number of the media M is 10 or more is larger than the necessary heat storage amount $Q_{A32}$ when the medium M is 1 (i.e. $Q_{A13}<Q_{A33}$). Therefore, the speed-change-decision criterion temperature difference ΔTth differs depends on the number of the media M.

In FIG. 20, H13 represents ΔTth1 [VH], H23 represents ΔTth2 [VH], and H33 represents ΔTth3 [VH]. Further, M23 represents ΔTth2 [VM], and L23 represents ΔTth2 [VL]. In the example shown in FIG. 20, the following relationship is satisfied: H13<H23<H33<M23<L23. The speed-change-decision criterion temperature difference ΔTth differs depending on the printing speed $V_H$, $V_M$ or $V_L$.

In this way, the speed-change-decision criterion temperature difference ΔTth [Vprn] corresponding to the printing speed (i.e., the rotation speed) can be determined.

As described above, according to the second embodiment of the present invention, the heat storage amount at start of medium passing is increased by increasing the rotation speed V taking into consideration the decrease in the temperature of the fixing roller 64 after the medium M reaches the fixing unit 6 (caused by the change in the environmental temperature, i.e., the temperature of the medium M). Therefore, the decrease in the temperature of the fixing roller 64 immediately after the medium M starts passing through the fixing unit 6 can be reduced. Accordingly, fixing failure can be prevented even when the environmental temperature varies on condition that the upper/lower temperature difference ΔT0 is small.

In this regard, the above described Modifications 1 and 2 can also be applied to the first embodiment.

In the above described embodiments, an electrophotographic printer has been described as an example of the image forming apparatus. However, the present invention is also applicable to a facsimile machine, a copier, a multifunction peripheral or the like.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

a fixing member configured to fix an image to a medium by heating the medium;

a heating member configured to heat the fixing member;

a pressure member pressed against the fixing member so as to press the medium against the fixing member;

a first temperature detection unit that detects a temperature of the fixing member;

a second temperature detection unit that detects a temperature of the pressure member; and a control unit that controls a rotation speed of the fixing member;

wherein the control unit controls the rotation speed of the fixing member based on a temperature difference between the temperature detected by the first temperature detection unit and the temperature detected by the second temperature detection unit;

wherein the control unit has a plurality of selectable printing speeds that define rotation speeds of the fixing member when the medium passes the fixing member, and has a plurality of selectable speed-change-decision criterion temperature differences respectively corresponding to the printing speeds; and wherein the control unit selects one of the speed-change-decision criterion temperature differences according to the selected printing speed, and determines the rotation speed to be the same as or different from the printing speed based on the selected speed-change-decision criterion temperature difference.

2. The image forming apparatus according to claim 1, wherein the control unit controls the rotation speed of the fixing member when the temperature detected by the first temperature detection unit is within a fixing-enabling temperature range.

3. The image forming apparatus according to claim 1, wherein the control unit increases the rotation speed of the fixing member, as the temperature difference becomes smaller.

4. The image forming apparatus according to claim 3, wherein, when the temperature difference is smaller than or equal to a predetermined value, the control unit sets the rotation speed of the fixing member to a second rotation speed that is higher than a first rotation speed at which a fixing process is performed.

5. The image forming apparatus according to claim 4, wherein the control unit changes the rotation speed of the fixing member from the first rotation speed to the second rotation speed before the medium reaches the fixing member.

6. The image forming apparatus according to claim 5, wherein, when the temperature difference is smaller than or equal to a predetermined value, the control unit controls the rotation speed of the fixing member according to the temperature difference.

7. The image forming apparatus according to claim 6, wherein, when the temperature difference is expressed as $\Delta T0$ and the rotation speed of the fixing member is expressed as $V_A$, the control unit sets the rotation speed $V_A$ of the fixing member based on the following equation:

$$V_A = A \times \Delta T0 + B$$

where A and B are constants.

8. The image forming apparatus according to claim 1, further comprising a third temperature detection unit that detects a temperature in the image forming apparatus.

9. The image forming apparatus according to claim 8, wherein the control unit sets the rotation speed of the fixing member to a higher speed, as the temperature detected by the third temperature detection unit becomes lower.

10. The image forming apparatus according to claim 1, further comprising a medium thickness setting unit that sets a thickness of the medium.

11. The image forming apparatus according to claim 10, wherein the control unit sets the rotation speed of the fixing member to a lower speed, as the thickness of the medium set at the medium thickness setting unit becomes thinner.

12. The image forming apparatus according to claim 1, further comprising a medium number detection unit that detects a number of medium on which image formation is to be performed.

13. The image forming apparatus according to claim 12, wherein the control unit sets the rotation speed of the fixing member to a higher speed, as the number of medium detected by the medium number detection unit becomes larger.

14. The image forming apparatus according to claim 1, wherein the rotation speed of the fixing member before the medium reaches the fixing member differs depending on the temperature difference.

15. The image forming apparatus according to claim 1, wherein the control unit changes a timing at which the control unit changes the rotation speed from the printing speed.

16. The image forming apparatus according to claim 1, wherein the control unit selects one of the speed-change-decision criterion temperature differences according to the printing speeds and an environmental temperature.

17. The image forming apparatus according to claim 1, wherein the rotation speed of the fixing member before the medium reaches the fixing member differs depending on an environmental temperature.

18. The image forming apparatus according to claim 1, wherein the speed-change-decision criterion temperature difference differs depending on a thickness of the medium.

19. The image forming apparatus according to claim 1, wherein the speed-change-decision criterion temperature difference differs depending on a number of the medium on which printing is to be continuously performed.

20. An image forming apparatus comprising:

a fixing member heated by a heating member, the fixing member being configured to fix an image to a medium by heating the medium;

a pressure member pressed against the fixing member so as to press the medium against the fixing member; and a control unit that controls a rotation speed of the fixing member;

wherein the control unit controls a rotation speed of the fixing member, the control unit causing the fixing member to rotate at a higher speed, as a heat storage amount in the fixing member becomes smaller;

wherein the control unit has a plurality of selectable printing speeds that define rotation speeds of the fixing member when the medium passes the fixing member, and has a plurality of selectable speed-change-decision criterion temperature differences respectively corresponding to the printing speeds; and wherein the control unit selects one of the speed-change-decision criterion temperature differences according to the selected printing speed, and determines the rotation speed to be the same as or different from the printing speed based on the selected speed-change-decision criterion temperature difference.

21. The image forming apparatus according to claim 20, wherein the control unit controls the rotation speed of the fixing member when the temperature of the fixing member is in a fixing-enabling temperature range.

* * * * *